US005777325A

United States Patent [19]

Weinberger et al.

[11] Patent Number: 5,777,325

[45] Date of Patent: Jul. 7, 1998

[54] DEVICE FOR TIME LAG FOCUSING TIME-OF-FLIGHT MASS SPECTROMETRY

[75] Inventors: Scot R. Weinberger, Montara; Edward P. Donlon, San Jose; Yevgeny Kaplun, Mountain View; Tor C. Anderson, Palo Alto, all of Calif.; Liang Li, Edmonton, Canada; Larry Russon, Edmonton, Canada; Randy Whittal, Edmonton, Canada

[73] Assignee: Hewlett-Packard Company, Palo Alto, Calif.

[21] Appl. No.: 643,708

[22] Filed: May 6, 1996

[51] Int. Cl.[6] ..... H01J 49/40

[52] U.S. Cl. ..... 250/287; 250/281

[58] Field of Search ..... 250/287, 281, 250/282, 288, 397

[56] References Cited

U.S. PATENT DOCUMENTS

| | | | |
|---|---|---|---|
| 4,472,631 | 9/1984 | Enke et al. | 250/287 |
| 5,202,563 | 4/1993 | Cotter et al. | 250/287 |
| 5,464,985 | 11/1995 | Cornish et al. | 250/287 |
| 5,498,545 | 3/1996 | Vestal | 436/47 |
| 5,504,326 | 4/1996 | Reilly et al. | 250/282 |
| 5,510,613 | 4/1996 | Reilly et al. | 250/287 |
| 5,594,243 | 1/1997 | Weinberger et al. | 250/288 |

FOREIGN PATENT DOCUMENTS 2278494 11/1994 United Kingdom .

OTHER PUBLICATIONS

Kinsel, et al., Post Source Pulse Focusing: A Simple Method to Achieve Improved Resolution in a Time-of-Flight Mass Spectrometer, International Journal of Mass Spectrometry and Ion Processes, 91 (1989), pp. 157–176.

Martin, et al., The Importance of the Time-Lag Parameter in a Laser/Time-of-Flight Mass Spectometer, International Journal of Mass Spectrometry and Ion Processes, 77 (1987), pp. 203–221.

Colby, et al., Space—Velocity Correlation Focusing, Analytical Chemistry, vol. 68, No. 8, Apr. 15, 1996, pp. 1419–1428.

Tabet, et al., Time-Resolved Laser Desorption Mass Spectrometry. II. Measurement of the Energy Spread of Laser Desorbed Ions, International Journal of Mass Spectrometry and Ion Processes, 54 (1983), pp. 151–158.

Wiley, et al., Time-of-Flight Mass Spectrometer with Improved Resolution, The Review of Scientific Instruments, vol. 26, No. 12, Dec. 1955, pp. 1150–1157.

Stein, Space and Velocity Focusing in Time-of-Flight Mass Spectrometers, International Jounal of Mass Spectrometer and ion Physics, 14 (1974), pp. 205–218.

Marable, et al., High-Resolution Time-of-Flight Mass Spectrometry—Theory of the Impulse-Focused Time-of--Flight Mass Spectrometer, International Journal of Mass Spectrometry and Ion Physics, 13 (1974), pp. 185–194.

Ogorzalek Loo, et al., State-Resolved Photofragment Velocity Distributions by Pulsed Extraction Time-of-Flight Mass Spectrometry, J. Phys. Chem., 1988, 92, pp. 5–8.

(List continued on next page.)

*Primary Examiner*—Kiet T. Nguyen

[57] ABSTRACT

A laser desorption ionization instrument for and method of measuring the molecular weight of large organic molecules includes a time of flight mass spectrometer (TOF MS). The TOF MS instrument provides optimized optic design for both DC and TLF modes. The invention further provides dynamic resolution enhancement for a given ejection pulse, along with optimized ion ejection pulses relative to the ion optic elements. The invention also provides means for compensating for difference in total kinetic energy among ions of different mass; high resolution detection means for improved sensitivity for large molecular weight species. The invention further provides x-y-z stage for sample presentation of both standard MALDI and gel or membrane based samples.

34 Claims, 14 Drawing Sheets

OTHER PUBLICATIONS

Ioanoviciu, et al., Time Focusing Magnetic Wedge–Field Sectors for Time–Resolved Ion Momentum Spectrometry, Rapid Communications in Mass Spectrometry, vol. 9, (1995), pp. 1238–1240.

Bakker, Time–Focusing Time–of–Flight Mass Spectrometry, Dynamic Mass Spectrometry, vol. 4, pp. 25–37. Has no dated.

Tabet, et al., Laser Desorption Time–of–Flight Mass Spectrometry of High Mass Molecules, Anal. Chem., 1984, 56, pp. 1662–1667.

Tabet, et al., Time–Resolved Laser Desorption. III. The Metastable Decomposition of Chlorophyll–α And Some Derivatives, International Journal of Mass Spectrometry and Ion Processes, 65 (1985), pp. 105–117.

Meron, Design and Optimization of Time–of–Flight Spectrometers, Nuclear Instruments and Methods in Physics Research A291 (1990), pp. 637–645.

Ioanoviciu, Ion–Optical Solutions in Time–of–Flight Mass Spectrometry, Rapid Communications in Mass Spectrometry, vol. 9, (1995), pp. 985–997.

Kinsel, et al., Resolution Enhancement in Linear Time–of–Flight Mass Spectrometry by Post–Source Pulse Focusing, International Jounal of Mass Spectrometry and Ion Processes, 104 (1991), pp. 35–44.

Yefchak, et al., Models for Mass–Independent Space and Energy Focusing in Time–of–Flight Mass Spectrometry, International Journal of Mass Spectrometry and Ion Processes, 87 (1989), pp. 313–330.

Whittal, et al., High–Resolution Matrix–Assistsed Laser Desorption/Ionization in a Linear Time–of–Flight Mass Spectrometer, Anal. Chem. 1995, 67, pp. 1950–1954.

Stein, On Time Focusing and Phase Space Dynamics in Time–of–Flight Mass Spectrometer Design, International Journal of Mass Spectrometry and Ion Processes, 132 (1994), pp. 29–47.

Breuker, et al., Pulsed Ion Extraction to Improve the Mass Resolution in a Low–Acceleration–Energy Linear–TOF Maldi Instrument, Institute for Medical Physics and Biophysics, Germany, 4 pages. Has no dated.

Juhasz, et al., Applications of Delayed Extraction Matrix–Assisted Laser Desorption Ionization Time–of–Flight Mass Spectrometry to Oligonucleotide Analysis, Anal. Chem. 1996, 68, pp. 941–946.

Colby, et al., Space–Velocity Correlation Focusing, submitted to Anal. Chem., Jul. 14, 1995, pp. 1–50.

Colby, et al., Improving the Resolution of Matrix–Assisted Laser Desorption/Ionization Time–of–Flight Mass Spectrometry by Exploiting the Correlation between Ion Position and Velocity, Rapid Communications in Mass Spectrometry, vol. 8, (1994), pp. 865–868.

Schuerch, et al., Enhanced Mass Resolution in Matrix–Assisted Laser Desorption/Ionization Linear Time–of–Flight Mass Spectrometry, Biological Mass Spectrometry, vol. 23, (1994), pp. 695–700.

Grundwurmer, et al., High–Resolution Mass Spectrometry in a Linear Time–of–Flight Mass Spectrometer, International Journal of Mas Spectrometry and Ion Processes, 131 (1994), pp. 139–148.

Brown, et al., Mass Resolution Improvement by Incorporation of Pulsed Ion Extraction in a Matrix–Assisted Laser Desorption/Ionization Linear Time–of–Flight Mass Spectrometer, Anal. Chem. 1995, 67, pp. 1998–2003.

Kinsel, et al., High–Resolution Mass Spectrometry of Large Molecules in a Linear Time–of–Flight Mass Spectrometer, American Society for Mass Spectrometry, 1993, 4, pp. 2–10.

Ioanoviciu, Linear Time–of–Flight Mass Spectrometers: Postsource Pulse Focusing Conditions and Mass Scale, American Society for Spectrometry, 1995, 6, pp. 889–891.

King, et al., High Resolution Maldi–TOF Mass Spectra of Three Proteins Obtained using Space–Velocity Correlation Focusing, International Journal of Mass Spectrometry and Ion Processes, 145 (1995), pp. L1–L7.

Vestal, et al., Delayed Extraction Matrix–Assisted Laser Desorption Time–of–Flight Mass Spectrometry, Rapid Communications in Mass Spectrometry, vol. 9, (1995), pp. 1044–1050.

Park, et al., An Inductive Detector for Time–of–Flight Mass Spectrometry, Rapid Communications in Mass Spectrometry, vol. 8, (1994), pp. 317–322.

Brown, et al., Mass Resolution Improvement by Incorporation of Pulsed Ion Extraction in a Matrix–Assisted Laser Desorption/Ionization Linear Time–of–Flight Mass Spectrometer, accepted by Analytical Chemistry, Rev. Apr. 3, 1995, pp. 1–23.

Spengler, et al., The Detection of Large Molecules in Matrix–Assisted UV–Laser Desorption, Rapid Communications in Mass Spectrometry, vol. 4, No. 9, 1990, pp. 301–305.

Fraunberg, et al., Collision–Induced Electron Emission from Surfaces in Negative–Ion Time–of–Flight Mass Spectrometry, International Journal of Mass Spectrometry and Ion Processes 133 (1994), pp. 211–219.

Kaufmann, et al., Secondary–Ion Generation from Large keV Molecular Primary Ions Incident on a Stainless–Steel Dynode, Rapid Communications in Mass Spectrometry, vol. 6, (1992), pp. 98–104.

Muga, Velocity Compaction—Theory and Performance, Analytical Instrumentation, 16(1), (1987), pp. 31–50.

TOFTEC Introduces the VCMS–1. The Only High Mass Resolution Time–of–Flight Mass Spectrometer with Patented Velocity Compaction (VC) Ion Focusing, contact: Toftec, P.O. Box 15358, Gainesville FL 32604, 6 pages. Has no dated.

Erickson, et al., Mass Dependence of Time–Lag Focusing in Time–of–Flight Mass Spectrometry—an Analysis, International Journal of Mass Spectrometry and Ion Processes, 97 (1990), pp. 87–106.

DEVICE FOR TIME LAG FOCUSING TIME-OF-FLIGHT MASS SPECTROMETRY

BACKGROUND OF THE INVENTION

1. Field of the Invention

The invention is related to a Time Of Flight (TOF) Mass Spectrometry (MS). More particularly, the invention relates to time lag focusing in matrix assisted laser desorption time of flight mass spectrometry.

2. Description of Related Art

Laser desoprtion and MALDI-TOF are methods in which molecular weight of poorly volatile molecules can be determined. In laser desorption analysis samples are prepared as dried crystals upon a sample probe. For larger molecules (mw>1000 Da, MALDI-TOF MS is the method of choice. Samples are prepared as solid state co-crystals or thin films by mixing them with an energy absorbing compound or colloid (herein after referred to as the colloid or the matrix) in the liquid phase, and ultimately drying this solution to the solid state. Matrix-analyte solid state products are irradiated using a pulsed laser source creating a two step phase transition: solid to liquid and liquid to gas. Desorption occurs during the liquid to gas change when a gaseous plume is emitted at supersonic velocity. Ionization is postulated to occur in all three phases.

Within the ion optic or source region of the TOF MS, created ions are accelerated to some final velocity by the application of uniform, static electric fields. After achieving constant velocity, these ions are allowed to drift down a fixed distance in a field-free analyzer region prior to striking a detector. The output of the detector is integrated at some duty cycle as a function of time with respect to the time of the irradiating laser pulse as sensed by the trigger photodiode. The molecular weight of an ion is then determined using the time-of-flight expression in which:

$$m/z=a(Tf-to)^2 \quad \text{(equation 1)}$$

Where:

m/z: is the ion's determined mass to charge ratio

Tf: is the total flight time of the ion to: is the time interval which exists between the triggering of the timing device and the acceleration of resultant ions a: is a constant which accounts for ion total kinetic energy and total flight distance The values for a and to are empirically determined by comparing the experimental tf for a number of well characterized analytes with their respective m/z. The determination of a and to calibrates the instrument and allows for more accurate m/z assignment. If calibration is performed while simultaneously analyzing an unknown sample mixture, an internal standard calibration is performed. If calibration is performed as a separate analytical run followed by the analysis of unknown species, an external calibration is performed. Typically, internal calibration runs produce greater accuracy than their external counterparts. The latter is due to the ability to effect fine adjustments in to and a, as subtle differences in analytical conditions may exist from one analysis to the next.

Fundamental problems in resolution and accuracy exist in current MALDI-TOF MS instruments. Resolution and accuracy in a MALDI-TOF MS is highly dependent upon the constant maintenance of the following factors for a given population of ions:

1. Total Kinetic Energy (KEt)
2. Total Flight Distance (dX)
3. Total Flight time (Tf)

$$m/z=\frac{(KEt)(Tf)^2}{(dX)^2} \quad \text{(equation2)}$$

KEt is the sum of a molecule's initial kinetic energy, namely, that energy which the gaseous neutral or ion possesses upon desorption, and the imparted kinetic energy which is the direct result of an ion's acceleration through an electric field.

For a moving neutral molecule or ion of mass m with a velocity of v, its kinetic energy is one half the product of m and v2 while for an ion of charge z passing through an electric field of strength E, its kinetic energy is the product of z and E. Under these conditions, imparting kinetic energy to a species is dependent upon the ionization of a desorbed neutral and/or the desorption of an ion. If all ions of a given mass are formed at the same location within field E, imparted kinetic energy can be tightly controlled using prudent instrument design. However because ionization occurs in solid, liquid, and gaseous phases, and because desorbed neutrals can ionize at various times and positions, an ion's initial position within field E is not constant and its imparted kinetic energy can not be controlled. This variation of imparted kinetic energy results in a loss of resolution and a corresponding decrease in m/z determination accuracy.

While the imparted kinetic energy an ion receives is dependent upon the field strength of the TOF source region, an ion's initial kinetic energy is directly related to one half the product of its mass and initial desorption velocity raised to the second power. It has been shown that for high molecular weight analytes, initial desorption velocities are approximately the same. Accordingly, initial desorption kinetic energy must increase with increasing ion molecular weight. This energy debt which exists between small and large analytes violates the constant maintenance of KEt and results in non-linearity of the time-of-flight expression.

For external standard measurements, nonlinearity in the time-of-flight expression introduces uncertainty or error in m/z determination for unknown analytes. The measured m/z of an unknown may be less than the actual m/z depending upon the mass difference between the unknown and the calibration species (see FIG. 2). If the unknown is heavier than the calibrants, the determined m/z will be less than the actual value because the calculated slope of the calibration function is less than it should be. Additionally, if the unknown is lighter than the calibrants, the determined m/z will be less than the actual value because the calculated slope of the calibration function is greater than it should be.

Nonlinearity may be described by using a polynomial expression whose coefficients are empirically derived using analytes of known molecular weight. But it can not be corrected while measuring very large molecules, such as proteins, glycoproteins, and polyoligonucleotides, for calibrants in this molecular weight range have yet to be well characterized. Consequently, there is risk of error in using published linear TOF expressions to determine m/z for very large molecules.

Another fundamental problem of MALDI-TOF MS involves multipath of desorbed analytes. Prior to acceleration, gas plume molecules (neutrals or ions) of a given mass m are emitted in a variety of directions during desorption. Not all of these molecules are colinear or coaxial with respect to the desired flight path (the desire flight path is defined as the flight path defined by the shortest line segment which is perpendicular to both the sample presenting and ion detecting surfaces). Consequently, all molecules do not have the same initial velocity with respect to the desired flight path. Moreover, in addition to multipath contributions, not all of the ions for a given m/z have the same initial speed regardless of their direction.

This distribution of initial velocities results in a coinciding distribution of initial kinetic energy (Uo) for a given m/z species . In order to improve resolution and accuracy for a given m/z, it is necessary to narrow the distribution of Uo. The width of an ion's Uo distribution is directly related to its mass. So larger ions have greater Uo energy distribution widths than lighter ions. Such distributions of Uo results in a loss of resolution and m/z determination accuracy.

Referring back to Equation 2, dX is the total distance which a desorbed ion will fly as it travels from the sample presenting surface (probe) to the detector. Variations in dX occur in radial and axial fashion. Radial variations are due to the omnidirectional expansion of the desorption plume. Axial variations are caused by omnidirectional gas plume expansion, differences in cocrystal size, sample-matrix film thickness, probe topography, and probe-ion optic engagement. As with variations in KEt, variations in dX also reduce resolution and m/z determination accuracy.

In equation 2, Tf is the time interval existing between desorption and detection of an ion. First principle, temporal variations in Tf occur due to: non-instantaneous desorption of ions or neutrals; simultaneous desorption of ions and neutrals; and variations in neutral axial position at their point of ionization. Other changes in Tf are due to variations in flight trajectory and differences in KEt for a given population of molecules. Instrumental parameters such as jitter or variability in digitizing duty cycle will also contribute to uncertainty in Tf. Uncertainty in Tf results in a loss of resolution and m/z determination accuracy.

Typically, MALDI-TOF MS is performed using constant, DC extraction of desorbed ions. During this process, an ion accelerating field is present during the desorption/ionization process. Consequently, ions of a given m/z which are ejected with different initial velocities, or formed at different initial locations, or formed at different times are respectively accelerated to different final velocities, or see different acceleration potentials, and have different total flight times. Clearly, non-uniformity of flight time hinders resolution and measurement accuracy.

Time Lag Focusing MALDI-TOF MS (TLF MALDI-TOF MS) functions to improve resolution and accuracy by uncoupling desorption/ionization from acceleration. Desorption/ionization is allowed to occur under isopotential conditions without an accelerating field. Field free drift of all formed ions and neutrals is allowed to proceed for some period of time Tl (lag time). Tl is chosen to be long enough to allow for proper focusing at a given ejection pulse potential, while being short enough to prohibit the fastest ions from drifting out of the field free region or the desorption cloud to radially expand out of the ion optic acceptance angle. Typical Tl periods range from several hundred nanoseconds to up to five microseconds.

Under TLF circumstances, ions ejected with different initial velocities, ions ejected at different times, or ions traveling along different paths will travel different axial distances within the field free region. Additionally, neutrals converted to ions at different times will assume axial positions solely dependent upon their initial velocities and will not see any ionization dependent differences in acceleration.

Upon the expiration of Tl, a constant ion ejecting high voltage pulse, typically square wave in nature, is applied to create a focusing field where the field free region existed. The strength of the focusing field is chosen to create a potential field gradient which differentially accelerates ions of identical m/z. Differential acceleration is achieved by virtue of the fact that ions located at different regions within the field see different field potentials. Slow moving or late forming ions see higher field potentials while fast moving or early forming ions see lower field potentials. The gradient is adjusted so that the previous population of ions catch up with the latter population at the point of detection.

In addition to compensating for differences in initial energy spread, TLF can also somewhat compensate for differences in initial position or desorption time frames. However, it can not compensate for initial energy spread among similar ions of different positional or temporal frames.

In spite of the desireablility of TLF in analysis of large molecules, a number of serious shortcomings remain. Challenges associated with instruments currently available include nonoptimized dual TLF and DC ion optic design; limited dynamic resolution enhancement range for a given ion ejection pulse; nonoptimal coupling of ion ejection pulses to ion optic elements; undesired ejection pulse division among ion optic elements; inability to compensate for differences in total kinetic energy among ions of different mass; the use of high resolution detectors with poor sensitivity for large molecular weight species; and a nonoptimal incorporation of x-y-z movable sample stages for standard MALDI as well as membrane and gel-based sample analysis.

While TLF as explained herein describes resolution improvement for a given species of m/z, nothing was said about the mass range over which a given, constant ion ejection pulse amplitude would focus and not unfocus liberated ions. This mass range is taken to be the TLF focusing dynamic range. Since the kinetic energy spread of a population of different ions will be directly proportional to the mass of these ions, it can be seen that no single, constant pulse amplitude will optimally focus all ions within a divergent population. These conditions may exist during the analysis of complex mixtures such as protein enzymatic digests, whole cell lysates, or greatly dispersed organic polymer mixtures. It may be necessary to perform an initial analysis using DC extraction followed by an array of different TLF analyses which are ultimately combined to form a composite mass spectrogram. Thus, for optimal analysis of large molecules a dual function DC/TLF system would prove tremendously useful.

Also useful in the analysis of large molecules would be a TLF-DC source design providing extended TLF dynamic focusing range. Extended range would allow for easier determination of various qualitative/quantitative values such as mean molecular weight, mean molecular number, and polydispersity often desired during the analysis of complex organic polymer mixtures.

Current TLF instrument designs incorporate direct coupling of a pulsing device (pulser) or high speed switching between different power supplies as a means of generating ejection pulses within ion optic assemblies. Direct coupling of a pulser to ion optic elements raised at high potentials requires the ground plane of the pulser to be electrical floated to the potential of the source. Not only is this a cumbersome process but it also leads to instability in pulser operation. Typically, switching within such pulsing devices is accomplished though the use of high voltage Field Effect Transistors (FETs). These FETs are exquisitely sensitive to excess potential differences which can occur during high voltage arcing episodes. Floating a pulser at very high potentials increases the possibility of arcing between the pulser and the instrument ground plane. A single high voltage arc could render the pulser nonfunctional. Clearly, this approach fails to provide a reliable instrument. What is needed is a reliable coupling of the pulser and ion optic elements.

In high speed switching configurations, different source element potentials are created by using different high voltage power supplies. Isopotential conditions maintained during the lag period are then the result of setting two different high voltage power supplies to the same setting. The accuracy of such high voltage power supplies are no better than ±0.1%. Consequently, an isopotential plane of 20 kV may actually see as a potential difference as large as 40 volts, introducing unwanted and inconsistent ion acceleration during the lag period, and resulting in attendant losses in resolution and accuracy.

The ejection pulse in high speed switching systems is created as one of the source elements in the isopotential plane is rapidly switched to the output of a high voltage power supply set at a voltage which is greater than the potential of the isopotential field. Because this switching event is not instantaneous, isopotential conditions are temporarily interrupted and ions are accelerated in an unwanted field prior to application of the ejection pulse. Such perturbations may be constant but nevertheless add to the complexity of the TLF measurement process and may ultimately limit resolution and accuracy. Additionally, because the herein described method involves switching to a new DC level, no true ejection pulse is created. Such a direct coupled approach does not easily lend itself to alterations in applied ion ejection potential or wave form as a function of time.

Electrically speaking, a DC or TLF ion optic assembly can be modeled as a series array of capacitively coupled plates. For a series assembly of capacitors coupled to an electrical pulse, the voltage drop across each capacitor is inversely proportional to the capacitance of the element in question. For the majority of a given TLF ion ejection pulse to be dropped in the source isopotential region, the capacitance of the isopotential region must be much, much less than the capacitance of the remaining source regions. If this is not the case, unwanted pulse voltage division will occur across all stages of the source assembly, resulting in less than optimal ion spatial and temporal focusing performance, minimizing attainable resolution and m/z accuracy. No solution to this problem has been put forward.

Avoiding such pulse related voltage division is also important during the employment of pulsed deflection fields which typically act as ion gates. Under these conditions, pulses from ion gate fields need to be minimally coupled to source acceleration optic elements just as pulses from the acceleration optic elements need to be electrically isolated from ion gate elements. Current solutions have focused upon ion guide technology or altered system detector duty cycles. No solution is yet completely satisfactory.

Ion gating by means of ion guide technology selectively applies ion trajectory desabilizing electrical pulses upon a predetermined region of a multi-stage ion guide assembly. As undesired ions approach the gating stage, a trajectory desabilizing pulse is applied. When these ions see this pulse, their trajectories are altered so that they do not strike the system detector.

The ion guide gating stage is typically several centimeters in length and acts as an excellent antenna when pulsed. Consequently, transient changes in the system's ground plane and other components due to capacitive coupling during pulse rise and decay periods occur. The latter perturbs ion guide efficiency in non-pulsed regions which may result in loss of resolution, accuracy, and sensitivity. Additionally, capacitive coupling with the detector anode may be observed, creating artifactual peaks on the data system. Solutions to these instrument performance challenges are actively sought.

Detector conversion dynamic range may also be preserved by prohibiting the conversion of unwanted ions, such as matrix ions. Some current MALDI TOF instruments selectively gate the detector voltage so that conversion surfaces are elevated to amplifying potentials only when ions of interest are present. This avoids electron depletion often seen during the conversion of matrix signal, improving sensitivity for species of interest. However, the resistance (2–100 megohm) and capacitance (1–1000 picofarad) of dual MCP assemblies are such that amplification rise times are typically 2–500 microseconds. Such rise times establish the minimum filter duration, minimizing ion selectivity in such filtering schemes.

Problematic in current TOF analysis is correction for the hereinabove described debt in total kinetic energy which occurs with increasing sample molecular weight. Also problematic is the compromise typically made in which detector high speed response is chosen over detector sensitivity for high molecular weight analytes. In MALDI-TOF MS, ion detection is typically achieved through the use of electron multiplier (EMP) or microchannel plate (MCP) technology. Because the overall response time of MCP's out performs that of EMP's, MCP's are the preferred solution. The efficiency at which an MCP converts an ion to many electrons is known as the conversion efficiency. Typical MCP conversion efficiencies for small ions has been shown to be 103–104 per plate. For the most part, two MCP assemblies are used in series to provide a total gain approaching 108.

MCP conversion efficiency has been shown to be inversely proportional to ion molecular weight. Consequently, the sensitivity for high molecular weight ions is typically far worse than that for low molecular weight ions. In an effort to correct for this disparity, prior art teaches the use of secondary ion generators or conversion dynodes (see FIG. 4). When large primary ions collide with a secondary ion generator, smaller, more easily converted secondary fragment ions (M-n+H), neutrals (n) and/or sputtered product ions (Cu+) are created which are ultimately accelerated to the MCP conversion surface. Similarly, when large primary ions collide with a conversion dynode, smaller secondary ions are sputtered off the dynode surface and accelerated towards the MCP conversion surface.

Current approaches of merely positioning secondary ion generators and conversion dynode surfaces a sufficient distance from MCP conversions surfaces to avoid electrical arcing and other perturbations introduce secondary or product ion multipath which limits system resolution. Moreover, differential post acceleration as well as the initial velocity differences of non incident parent ions, intact incident parent ions, secondary fragment ions, and sputtered ions are also large enough to seriously limit system resolution. To correct these difficulties, high resolution MALDI-TOF MS systems have employed detector systems without secondary ion generators or conversion dynodes to avoid this situation.

Sample in gel and membrane form challenge current sample presentation devices. DC and TLF MALDI-TOF MS instruments may often use an x-y-z sample stage as the first element in the ion optic array. For the most part, actuation devices for these sample stages have been designed to accurately position the stage at the proper orientation with respect to the next ion optic element, typically an extractor.

However, problems arise in the analysis of samples supported by membranes or polymeric gels.

Membrane or gel supported samples provide positional and energetic uncertainty when they are placed on the surface of a sample stage. The use of adhesive tape or glues to fix gels or membranes to the stage do not satisfactorily flatten the gel or membrane. The resulting positional uncertainty violates the constant maintenance of dX, and reduces resolution and accuracy. Glues and tapes, moreover, as well as irregularities within a given gel or membrane thickness and composition, introduce dielectric variation creating non-uniformity in electrical clamping, uncertainties in imparted kinetic energy and aberrations in temporal/spatial focusing dynamics—all of which reduce resolution and accuracy. What is needed is a sample presentation device that provides satisfactory presentation of gel and membrane samples.

A further complication introduced by the use of adhesive pastes or tapes is released gas which is a direct consequence of the adhesives vapor pressure creating outgassing in an ultrahigh vacuum environment. This released gas will create a localized increase in the number of gas molecules at the region of desorption. This, in turn, increases the frequency of collision between desorbed sample species and background gas molecules. Results are a broadened initial kinetic energy distribution and an increased ion multipath—both undesireably decreasing resolution and accuracy.

Focusing field distortion is another challenge of current x-y-z stage design. Current x-y-z sample stage edges are precipitous and flat with respect to the rest of the sample stage surface, thereby defocusing and distorting acceleration fields at the stage's edges. This limits the usable surface of the sample stage to only that portion which maintains parallel or focusing electrical fields. Depending upon several other ion optic characteristics, as much as several millimeters to a few centimeters may be lost per sample edge, seriously limiting sample throughput and analyzable sample size. What is needed is a stage that fully optimizes usable sample presentation surface area.

In sum, what is needed is an apparatus that provides: optimized dual TLF and DC ion optic design; increased dynamic resolution enhancement range for a given ejection pulse; optimal coupling of ion ejection pulses to ion optic elements; suppression of undesired ejection pulse division among ion optic elements; compensation for differences in total kinetic energy among ions of different mass; the use of high resolution detectors with good sensitivity for large molecular weight species; and a optimal incorporation of x-y-z movable sample stages for standard MALDI as well as membrane and gel-based sample analysis.

BRIEF SUMMARY OF THE INVENTION

The invention taught herein provides a laser desorption ionization method of and instrument for measuring the molecular weight of large organic molecules includes a time of flight mass spectrometer (TOF MS). The TOF MS provides optimized optic design for both DC and TLF modes. The invention further provides dynamic resolution enhancement for a given ejection pulse, along with optimized ion ejection pulses relative to the ion optic elements. The invention also provides means for compensating for difference in total kinetic energy among ions of different mass; high resolution detection means for improved sensitivity for large molecular weight species. The invention further provides x-y-z stage for sample presentation of both standard MALDI and gel or membrane based samples.

BRIEF DESCRIPTION OF THE DRAWINGS

The accompanying drawings, which are incorporated in and constitute a part of the specification, schematically illustrate a preferred embodiment of the invention, and, together with the general description given above and the detailed description given below, serve to explain the principles of the invention.

DETAILED DESCRIPTION OF THE INVENTION

The invention taught herein solves the previously mentioned shortcomings of currently practiced TLF or DC MALDI-TOF MS systems. The invention provides an instrument for measuring the molecular weight of large organic molecules comprising a MALDI TOF MS with time lag focusing and including improvements to source ion optic design, source high voltage systems, modes of delivering ion ejection pulses, profiles of ion ejection pulses, system operation integration, system detector design, and introduction platform for both standard and membrane based samples.

Figure 1A:
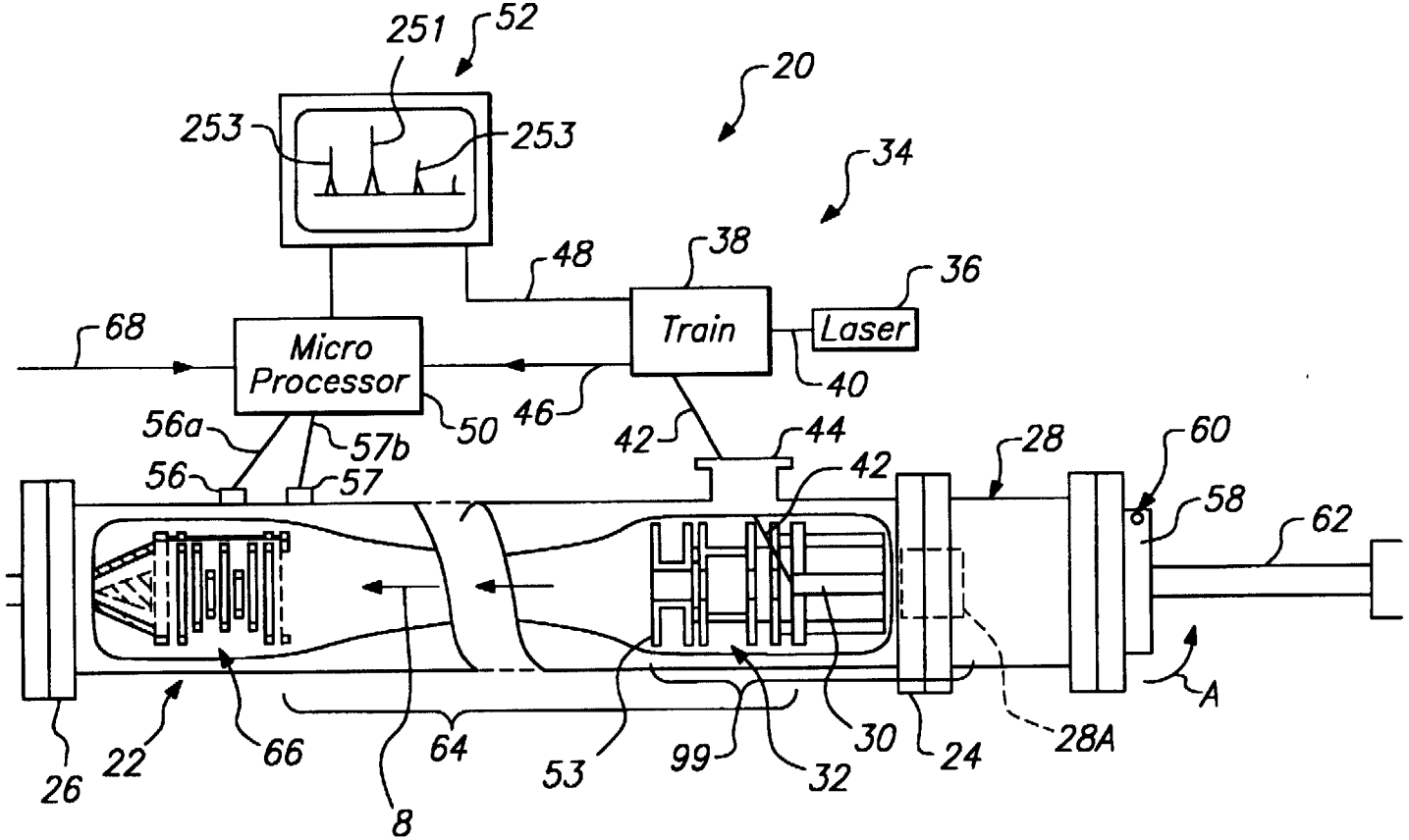
FIGS. 1A and 1B inclusive schematically illustrate a time lag focusing MALDI TOF MS according to the present invention.
Figure 1B:
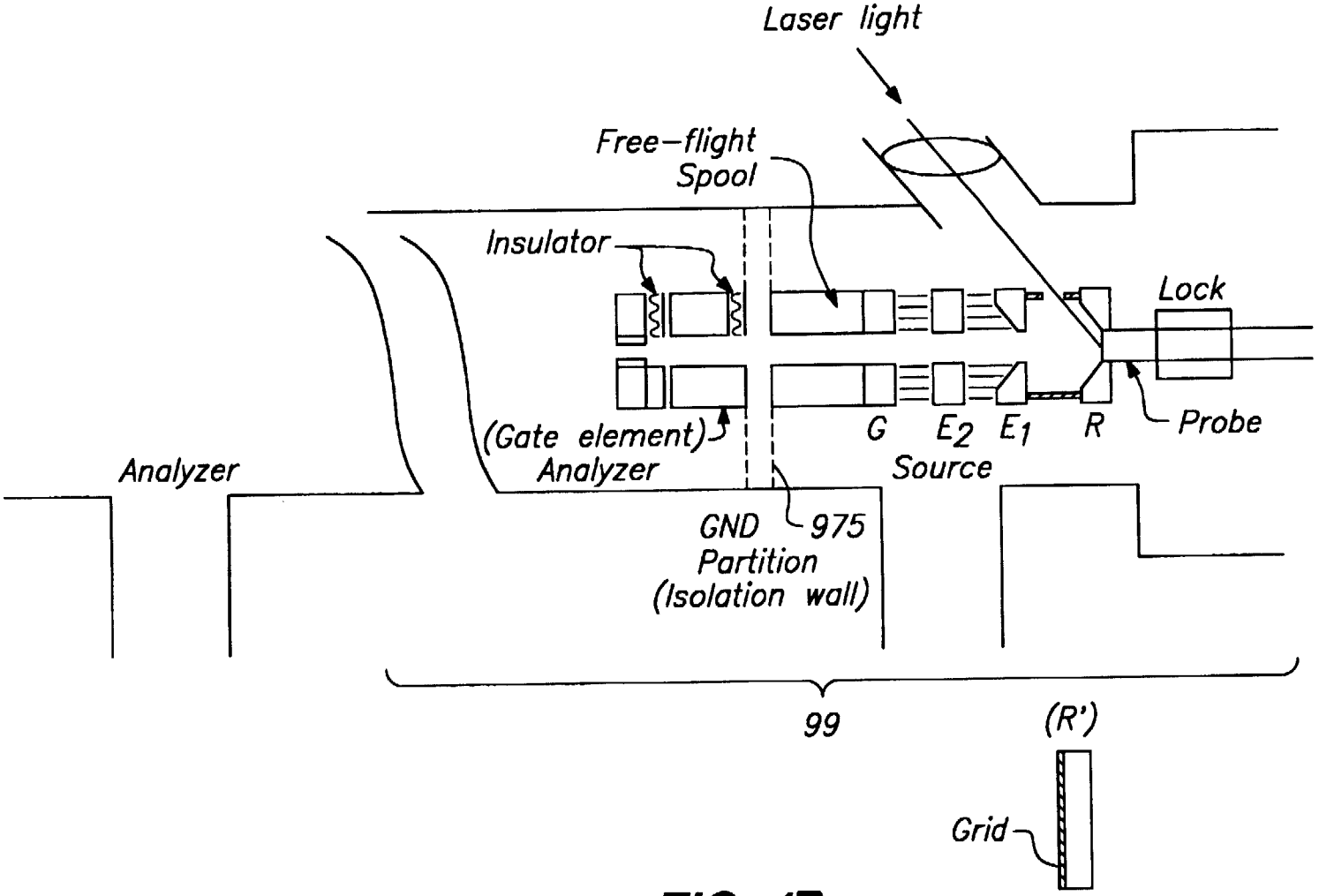
Figure 9:
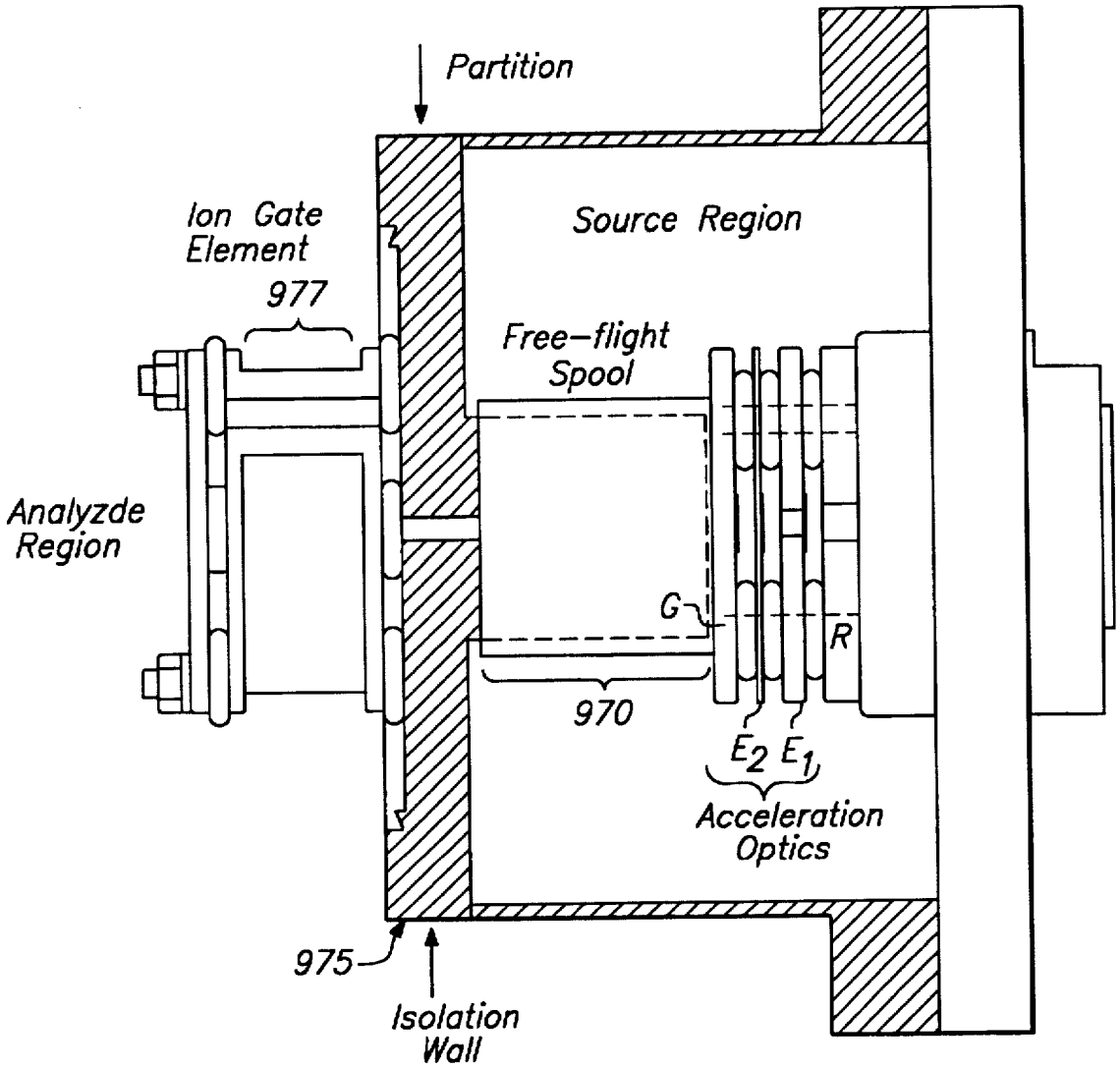
FIG. 9 is a schematic of source region, including ion acceleration and ion gate elements, of the apparatus of FIG. 1.

Referring now to FIG. 1, a schematic of the TLF MALDI TOF MS, denominated instrument 20 therein. Instrument 20 includes a generally cylindrical first vacuum chamber 22 forming, having end flanges 24 and 26. Chamber 22 may referred to as a time of flight tube, a flight tube or a drift tube. Chamber 22 is provided with means (not shown) such as a mechanical roughing pump and two high vacuum pumps such as a turbomolecular pump for establishing a pressure of $10^{-7}$–$10^{-8}$ torr therein. One pump is coupled with the sources of the instrument, the second pump is coupled with the analyzer portion. Mounted on end flange 24, is a second vacuum chamber 28, which may be termed a sample chamber. Sample chamber 28 may be isolated from or placed in vacuum communication with chamber 22. Located in sample chamber 28 is a means for storing a plurality of samples for analysis. Samples to be analyzed, in the form of crystallized layers of an analyte or analyte/matrix mixture are introduced through gate valve 28A and flange 24 into chamber 22 on a probe tip 30 and into ion optic assembly 32. Ion optic assembly 32 includes ion acceleration optics (further illustrated in FIG. 7) as well as ion gating optics (further illustrated in FIG. 9) and discussed in further detail below.

Laser radiation for irradiation of samples is provided by laser optics 34 which includes a pulsed laser 36 and a laser beam train 38 including various components (not shown in FIG. 1) for focusing and directing a beam (pulse) 40 from the laser. Laser beam train 38 directs output laser beam 42, which may be termed an irradiating pulse, into chamber 22 and onto probe tip 30 through laser port 44. Laser beam train 38 also provides a signal 46 indicating the initiation of the irradiating pulse from the laser beam train 38. Signal 46 is used to trigger other devices such as high speed A/D data acquisition system, a time lag focusing lag counter and an ion gate system. Laser beam train 38 also provides a signal 48, indicating the intensity of the irradiating pulse, to a computing device 52 such as a personal computer. Signals 46 and 48 may be provided, for example, by photodiodes.

Figure 5A:
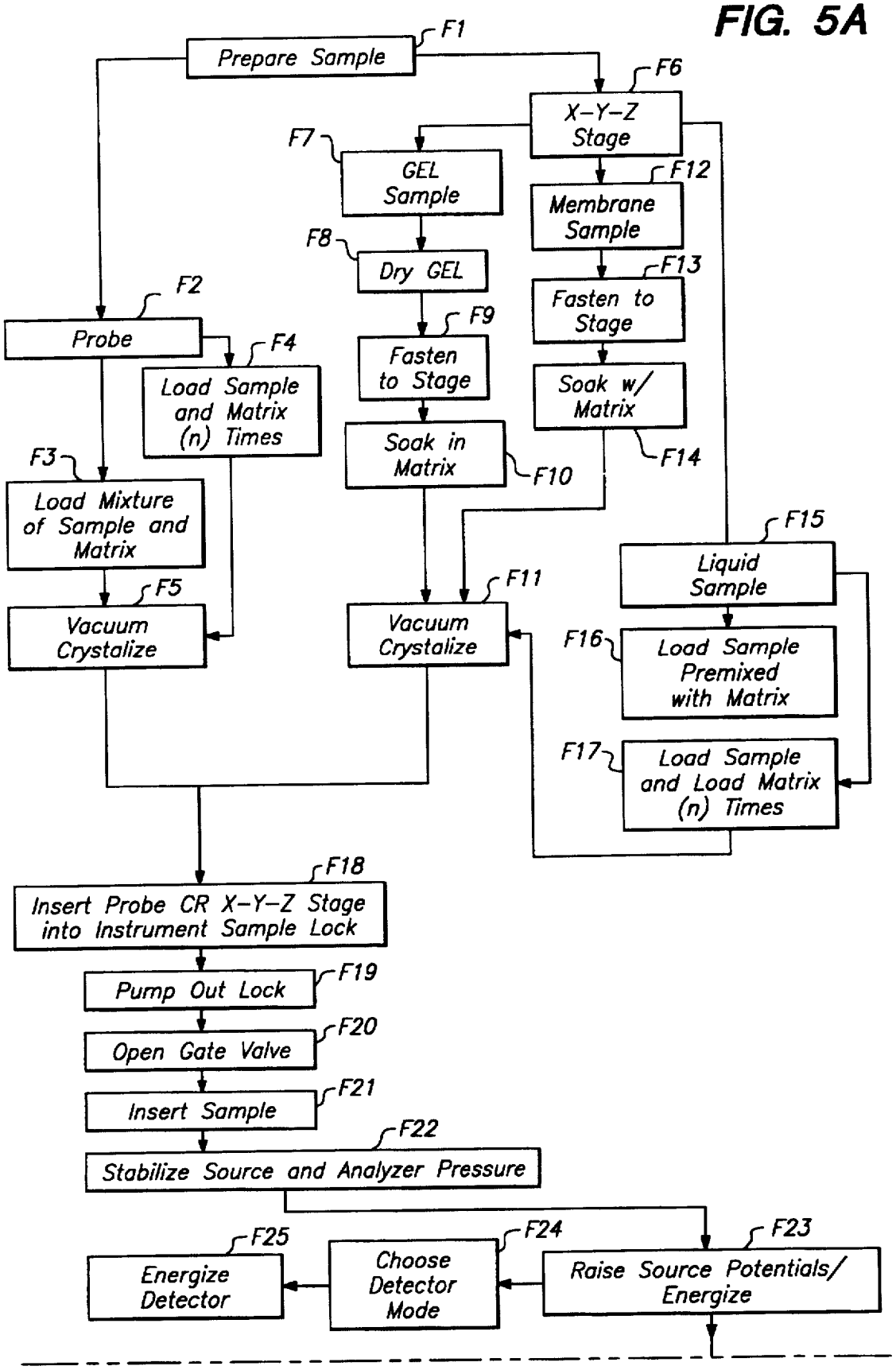
FIG. 5 is a flow chart depicting the sequence of various steps of operation of the instrument of FIG. 1.
Figures 5, 5B:
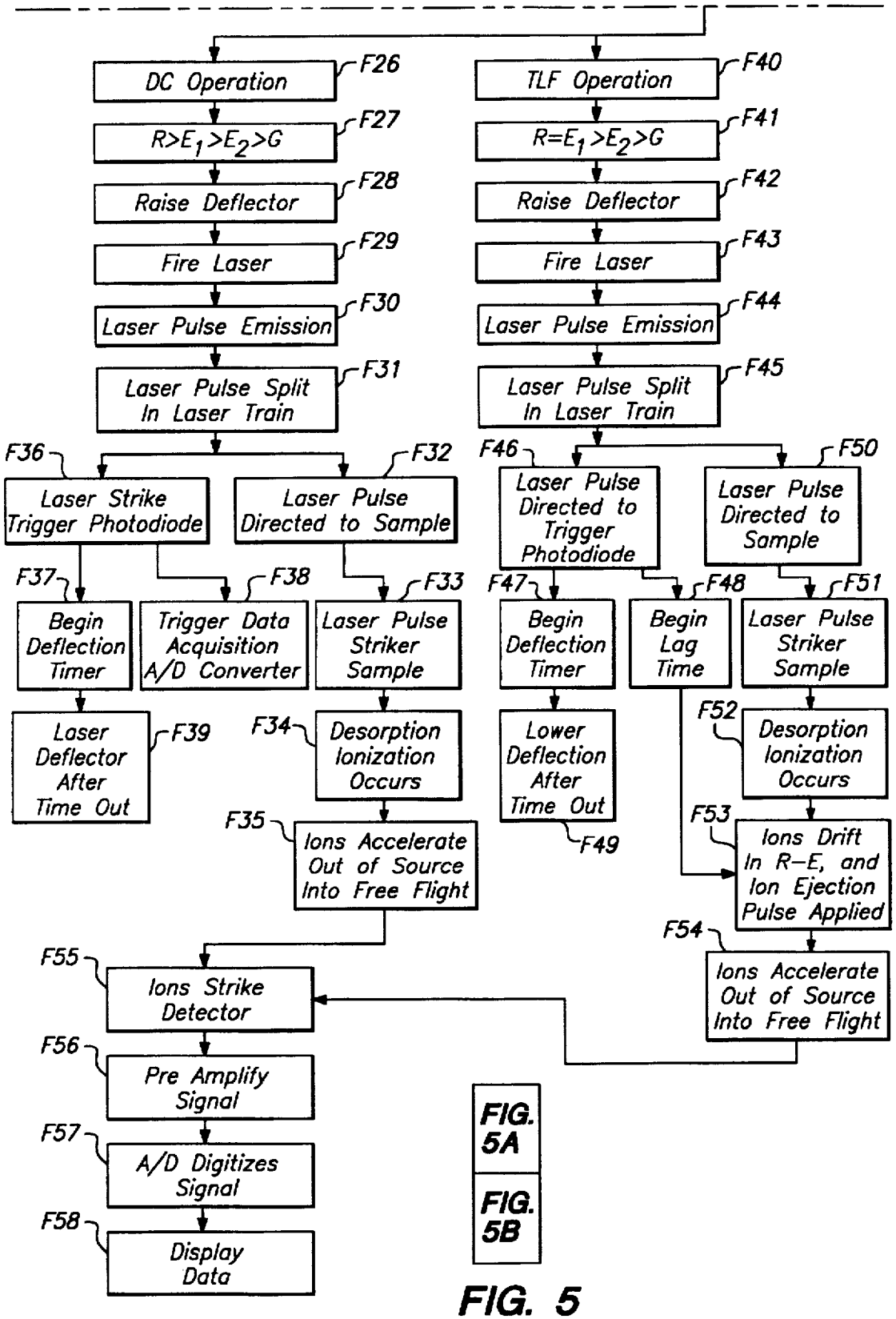
Figure 6:
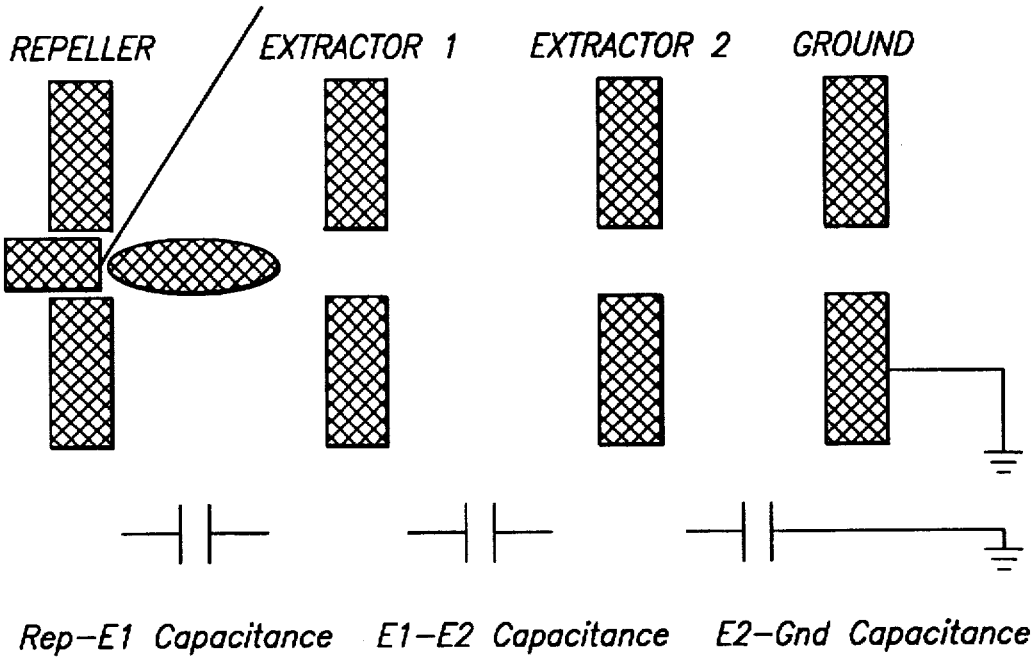
FIG. 6 is a representation of the preferred embodiment of the DC TLF optic as taught in the invention.

Other components depicted in FIG. 1 will now be described in conjunction with a description of an exemplary operation sequence of instrument 20. The general theory of operation and signal processing may be followed in flow chart form by reference to FIG. 5 wherein the various steps are depicted in Blocks F1 through F58.

A crystallized layer of sample/matrix mixture is applied to probe tip 30 (Block F2–F5) or the x-y-z stage (Block F6–F16) and vacuum crystallized (Blocks F5, F11). The probe or x-y-z stage is placed into a vacuum valve or lock 58 (which may be termed the sample lock) (Block F18) and into the sample chamber 28. Sample chamber is then pumped out or evacuated (lock F19) to roughing levels. Gate valve 28A is opened allowing sample mounted on probe tip or x-y-z stage to be introduced (Block F20–F21) into ion optics 32 (sample introduction shaft located within vacuum tube communicating with sample chamber not shown in FIG. 1). Vacuum in chamber 22, source and analyzer pressure, is stabilized (Block F22). Source potential is raised (Block F23). Detector mode, either DC or TLF, is selected (Block F24). Detector is energized (lock F25).

Ion optic assembly 32 (depicted in detail in FIG. 9 discussed hereinbelow) are energized (Block F23). The invention herein provides either DC operation ion optics (Blocks F26 through F39) or TLF operation ion optics (Blocks F40 through F54).

The laser is fired to deliver an irradiating pulse (Blocks F29, F43). The operation triggers deflector timer (Block F37, F47) or lag timer (Block F48) such that a zero time reference is established in digital electronics. Laser beam strike the sample matrix and photo desorption ionization operation occurs at Block F34, F52. As will be described in more detail, this provides for acceleration of ion in ion optics (Block F35, F54) followed by the deflection of any unwanted analyte.

The resulting free flight provides for striking of the detector (Block F55). The signal is processed digitized, input to and displayed on a suitable PC (Blocks F56, F57, F58) or other human readable output media.

The brief description of the function and principle of the components of instrument 20 given above is provided to assist in the understanding of certain improvements and useful features of these key components which contribute to the sensitivity and accuracy of the molecular weight determinations. These improvements and useful features are included int the detailed description of certain principle components of instrument 20 set forth below.

Figure 7:
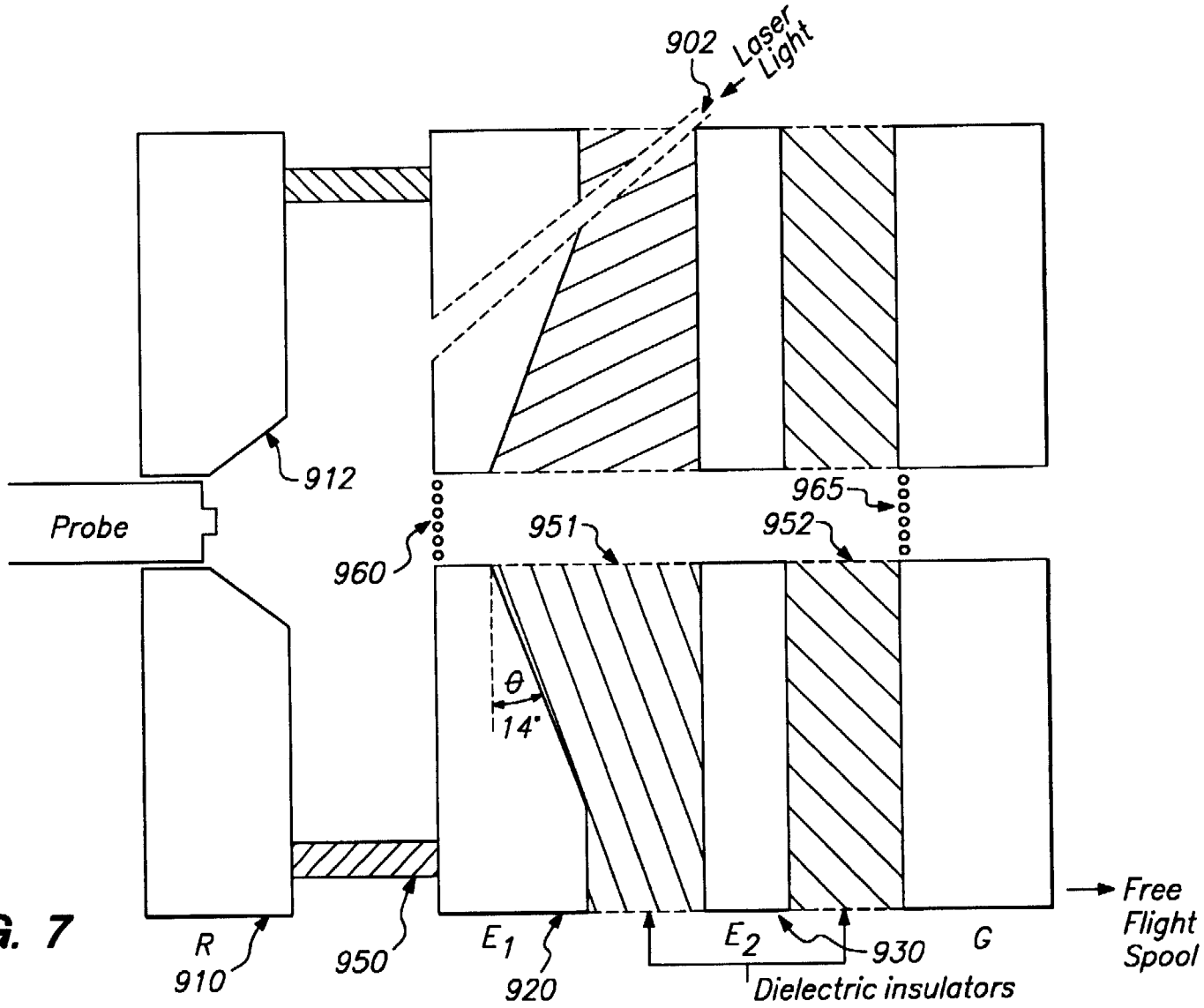
FIG. 7 is a schematic of the ion optic assembly depicted in FIG. 1, featuring ion acceleration elements according to the present invention.

FIG. 7 illustrates the embodiment of an improved DC-TLF ion optic assembly for use in MALDI-TOF MS, and is a detail of ion acceleration optics as depicted in FIG. 1. The system consists of four plates: plate one (repeller: R) 910, plate two (extractor 1: E1) 920, plate three (extractor 2: E2) 930, and plate four (ground plate: G) 940. These plates are constructed of any hard, high vacuum compatible, good conducting metal such as but not limited to stainless steel or aluminum. Each plate should be circular of varying diameters from 5 to 15 cm. The diameter of plates E1, E2, and G may be selected to be larger than the diameter of plate R so as to insure a higher capacitance between plates E1 and E2 as well as between plates E2 and G with respect to the capacitance between plates R and E1 to minimize unwanted pulse division.

Plates R, E1, E2 and G are physically separated and electrically isolated by dielectric insulators 950, 951, 952. The shape and corresponding area of these isolators are selected to control their contribution to net capacitance between ion optic plates. The insulator between R and E1 can be composed of four, individual spacers of small diameter and total surface area. The latter insures a low dielectric strength between R and E1, thus minimizing capacitance at this stage. The insulators between E1 and E2 as well as E2 and G may be continuous discs with cutouts for central apertures and laser access. This maximizes dielectric strength and associated capacitance among these various stages. This geometry maximizes ejection pulse voltage drop across stage R–E1 while minimizing unwanted pulse division among all remaining stages.

Plate R may be a disc with a central aperture or slightly eccentric aperture to accept a circular sample probe which accommodates a single sample or plurality of samples. An angled recess 912 or concavity is present on the E1 facing side of plate R. The concave recess provides soft focusing of all desorbed ions without introducing significant time aberrations due to significant ion multipath. The result is increased analyzer sensitivity without deleteriously effecting resolution. The recess is selected to be between 0.5 to 2.5 mm deep depending upon the applied potential difference between plates R and E1 during DC or ion ejection TLF modes of operation.

Figure 8:
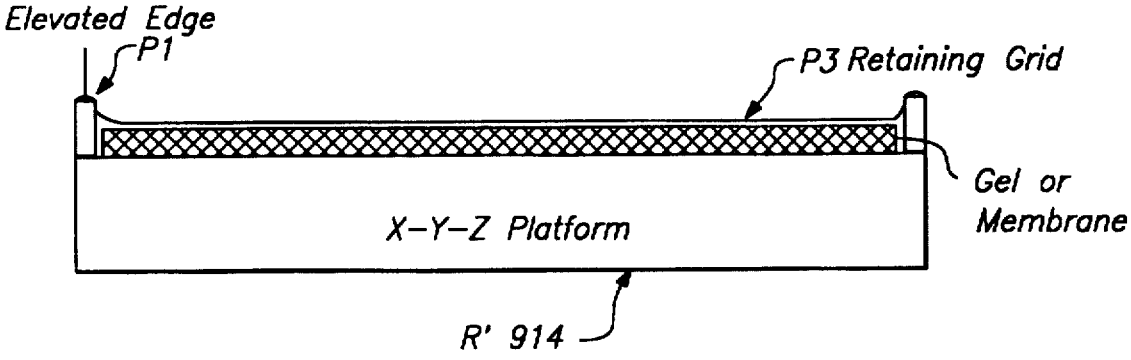
FIG. 8 is a representation of an alternate embodiment of one inventive aspect relating to x-y-z stage sample presentation as depicted in FIG. 7.

In an alternate embodiment as depicted in FIG. 8, plate R, depicted as $R^1$ 914, may be a rectangular or square prism with elevated, rounded borders or perimeter P1 which are from 1–3 mm high and 1–3 mm thick. In this application, plate R may be linked to a three dimensional actuation device which provides for the installation and proper positioning of plate R with respect to plate E1 as it is introduced from outside of the source region. Additionally, the actuation device could allow for the translation of plate R in horizontal or vertical planes while maintaing a constant position with respect to axial distance to plate E1 (z axis). Such movement of plate R allows the sampling of a plurality of samples or the analysis of samples embedded upon the surface of a membrane or polymeric gel. The elevated edges of plate R produces focusing to parallel electric fields at the periphery of the plate, allowing for the accurate analysis of samples as close as 1–2 mm from the edge.

An optional sample retaining grid P3 is provided to positionally and electrically clamp samples presented upon membranes or gels precisely with respect to the x-y-z sample stage. The grid is of sufficient transmission to allow unimpaired incidence of desorbing laser pulses while maintaining sufficient structural rigidity to avoid bending or other distortions of shape. The grid can be composed of any good conducting, ultrahigh vacuum compatible metal such as but not limited to copper, nickel, gold, and stainless steel.

Sample positional certainty is maintained by positive contact with and mechanical force exerted upon the membrane or gel by the sample retaining grid. Only sufficient force to position the gel or membrane is applied. Excessive force which may drive the grid into the gel or membrane, thus distorting gel/membrane shape and introducing positional uncertainty is avoided.

Uniform electric clamping is provided by elevating the grid to the same potential as the supporting sample stage. Acceleration potentials are gradually increased in alternating current fashion (AC) until the desired amplitude is achieved. Static DC current is then applied to fix the sample presenting surface and sample retaining grid at the desired DC acceleration or TLF lag period potentials. This AC/DC approach insures proper capacitive coupling of all gel or membrane regions of the repeller. During TLF ion ejection mode, the attendant AC pulse maintains proper electrical coupling of all repeller surfaces. For both TLF and constant DC modes, the inherent source potential drop due to ion acceleration and/or ion electrical plating results in a concomitant AC change in repeller potential, thus providing additional clamping of all surfaces for subsequent laser shots.

Plate E1 is positioned from 2 to 10 mm away from plate R. E1 plate thickness can vary from 1 to 6 mm. In the case of thicker E1 plates, the E2 facing surface should have a central concavity which contains a centrally located aperture. The concavity is of sufficient angle and length as to assure a 1–2 mm ultimate E1 plate thickness extending 1 to 3 mm from the edge of the E1 plate aperture towards the periphery. The E1 plate aperture has a diameter of 2 to 10 mm. The combination of the E1 plate concavity with the appropriate aperture diameter makes for soft focusing of desorbed ions in a fashion which increases collection efficiency without introducing significant time aberrations due to excessive ion multipath. The latter increases analyzer sensitivity while maintaining good resolution.

As depicted in FIG. 7, Plate E1 should contain a grid 960 covering the central aperture on its surface facing plate R. This grid should be of adequate transmission to allow sufficient ion transfer from R–E1 to E1–E2 sections of the source assembly. The transmission of the grid can also be varied in conjunction with the applied field strengths across R–E1 and E1–E2 regions to intentionally create a state of field penetration in the R–E1 stage during the lag period of the TLF duty cycle. Such field penetration can be selected to compensate for differences in Uo, narrowing the KEt energy debt and thus increasing the linearity of the time of flight expression.

Figure 2:
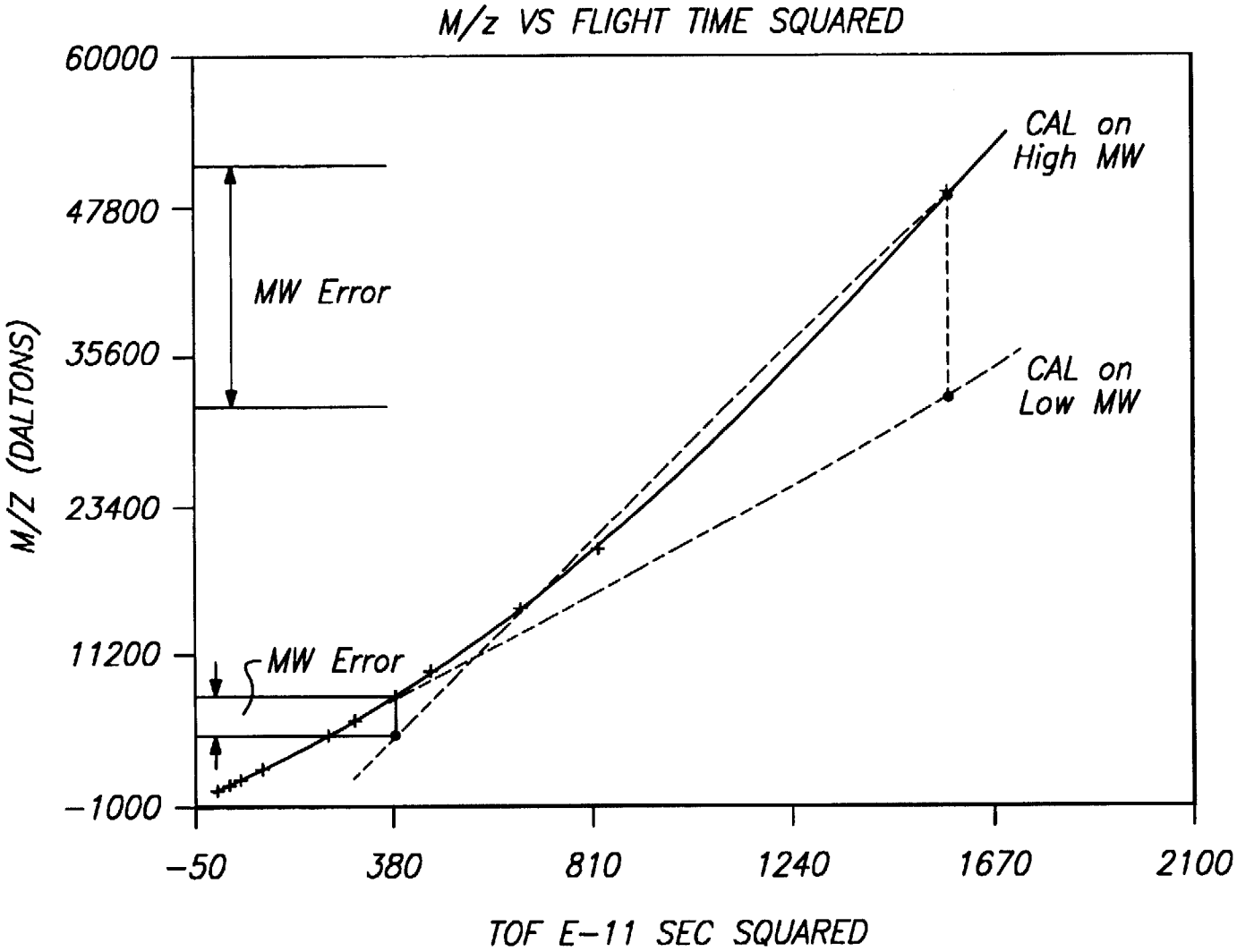
FIG. 2 illustrates the non-linearity of flight as it expresses itself in the error in m/z calibration for analytes.
Figure 3:
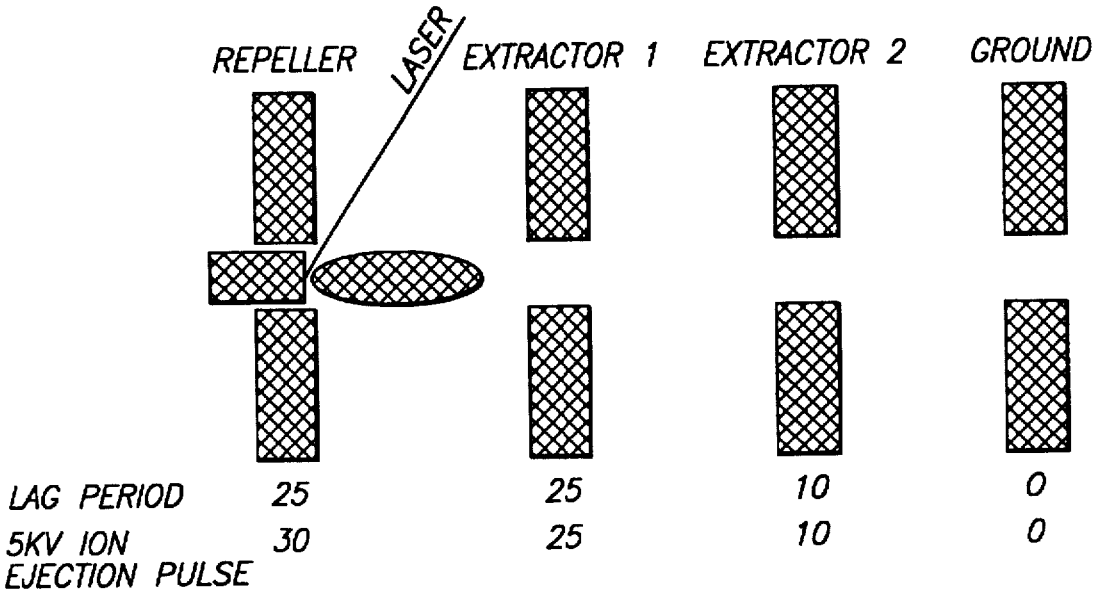
FIG. 3 schematically illustrates a time lag focusing configuration according to the present invention.
Figure 4:
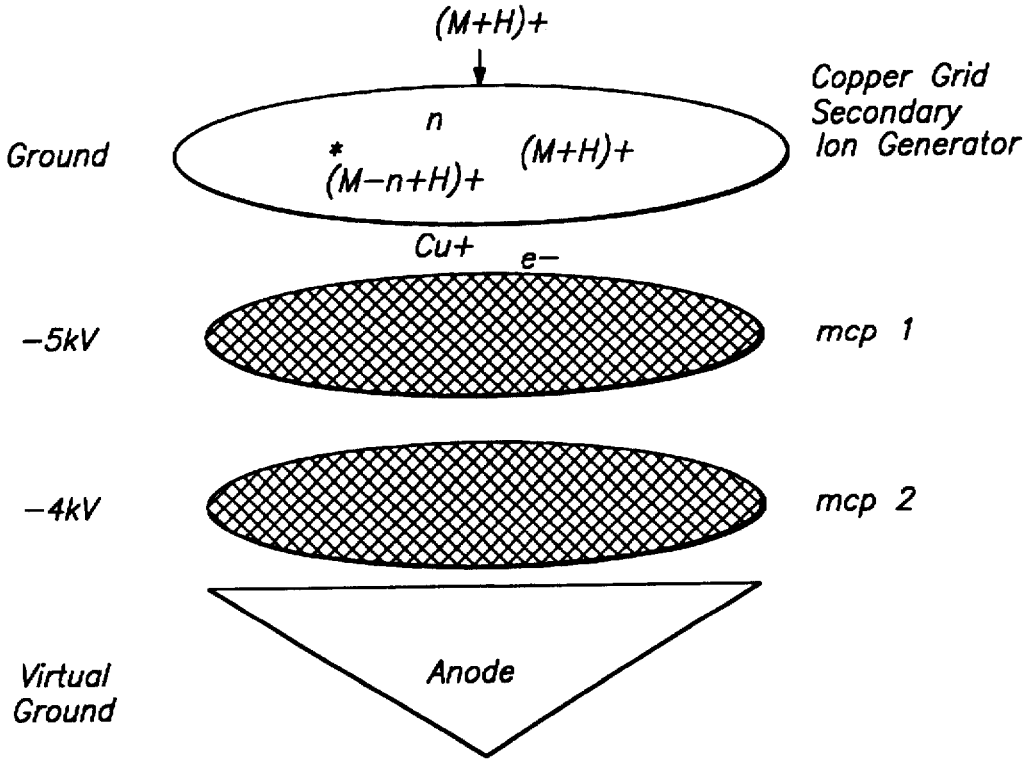
FIG. 4 (prior art) illustrates MCP detector with Cu+grid.

The Uo's of larger molecules are greater than the Uo's of smaller molecules. This, in turn, results in a condition which provides larger molecules with greater KEt than smaller molecules after acceleration to constant velocity. The calibration and mass accuracy ramifications of this condition was demonstrated in FIG. 2. If calibration was performed using lower molecular weight species, the determined molecular weight the larger species will be too low. Additionally, if calibration was performed using higher molecular weight species, the determined mass of the lower molecular weight compounds will also be too low.

Prudent selection of lag period field penetration allows for selective acceleration of lower molecular weight ions past larger molecular weight ions within a diverse desorption cloud population. The field penetration kinetic energy imparted to all species is the same, and accordingly, lighter ions achieve a higher velocity than heavier ions. Lighter ions now occupy positions within the R–E1 plane which correspond to lower potentials during ion ejection when compared to that of heavier ions. Consequently, the total flight time (Tf) for the lighter ion species is extended when compared to the change in Tf of heavier ions. The latter compensates for the previously explained energy debt among ions of divergent m/z, correcting for non-linearity in the time-of-flight expression.

It should be noted the application of a retarding field during the lag period will actually exacerbate the KEt energy debt between small and large molecules providing greater uncertainty in the determination of m/z. Additionally, the required field penetration strengths of typically between 5 and 50 v/mm to create this phenomenon are not easily attainable in gridless TLF/DC MALDI-TOF MS source designs with efficient spatial and temporal focusing characteristics.

Turning again to FIG. 7 and the description of the preferred source, plate E1 should be thicker at its periphery than in its center so as to allow a laser transmission channel to transverse E1's surfaces at a sufficient angle and length as to not create field disturbances by the penetration of E1–E2's field into R–E1's field. The unnecessary placement of grids in the laser train results in an undesired reduction in laser fluence which may prevent the analysis of high molecular weight analytes or other forms of laser desorption analysis such as surface enhanced neat desorption or surface enhanced affinity capture. The concave E1 approach eliminates this requirement.

Plate E2 should be positioned 3–6 mm away from plate E1. Gridless operation can be achieved by appropriate selection of E1–E2 and E2–G field strengths, proper selection of E2 thickness, and proper selection of E2 aperture diameter. E2 should be between 1 and 6 mm thick. The central aperture of E2 should be between 2 and 10 mm in diameter.

Plate G should be positioned 3–6 mm away from plate E2. Gridless operation of E2 may be achieved, however in all cases optimal ion collection efficiency and minimal multipath induced flight time aberrations have been seen while using a high transmission (90%) grid 965 across the E2 facing side of the G central aperture. Central aperture sizes should be from 3–6 mm.

In addition to the acceleration optic elements previously described, the preferred embodiment for a DC/TLF MALDI-TOF MS source also incorporates the use of an electrostatic pulse field ion gate. The ion gate can be used as a low pass, high pass, or notch filter, blocking out unwanted ions and allowing only a predetermined collection of ions to strike the system's detector. The latter allows for preservation of detector ion conversion dynamic range and/or selection of specific ion species for tandem mass spectral analysis.

Figure 10:
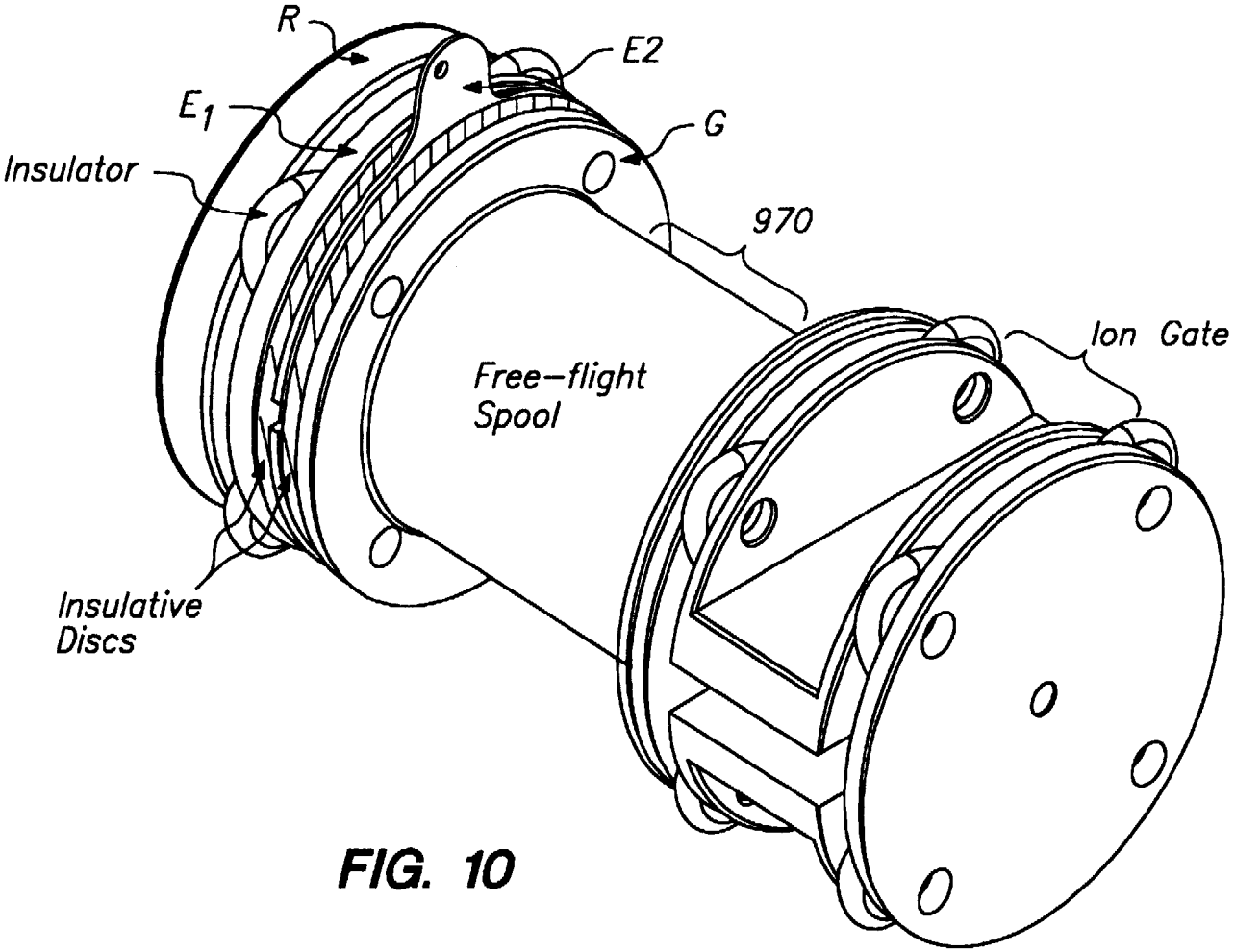
FIG. 10 is a perspective view of the source region of FIG. 9.

After leaving the source acceleration stages, ions are permitted to drift in a free-flight region defined within a cylindrical free flight spool (referred to as 970 in FIG. 10). The length of the free-flight spool is selected to optimize ion filter cut-off efficiency while minimizing ion loss secondary to radial spread. Typical lengths are from 50 to 150 mm.

In order to avoid unwanted pulse electrical coupling to acceleration optic elements during periods of ion gate operation, the pulse field ion gate should be located within the analyzer region of the TOF MS. Electrical isolation is achieved through the use of a shielding ground plane wall 975, FIG. 9, which partitions the ion gate 977 from the free flight spool 970, creating source and analyzer TOF MS regions. Possible coupling is further minimized by prudent control of instrument duty cycle. This is further explained in upcoming passages.

Figure 11:
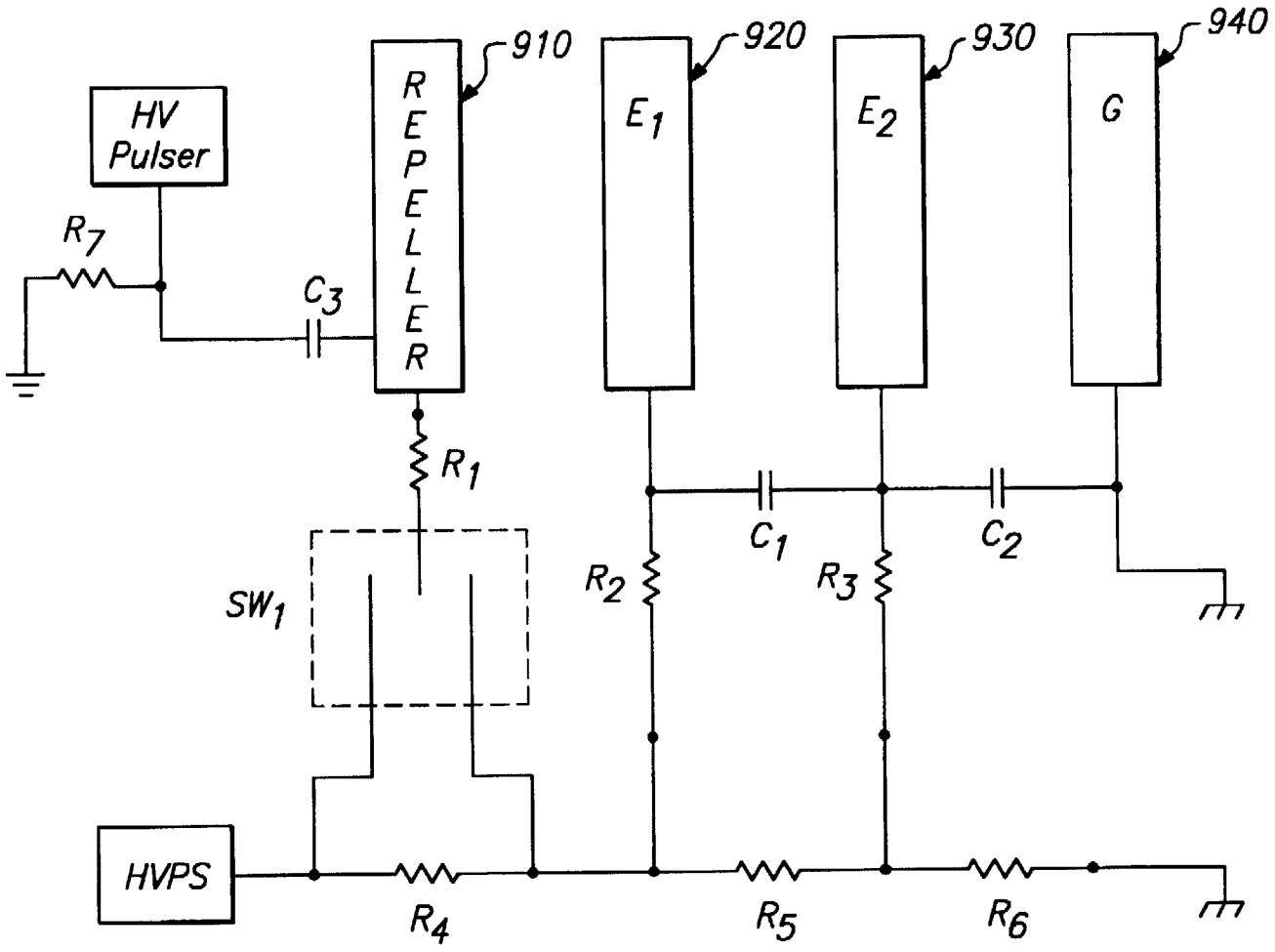
FIG. 11 is a schematic of electrical configuration of acceleration ion optics according to the present invention.

FIGS. 7 and 11 depict optimized dual DC and TLF MALDI-TOF MS operation as achieved through the combination of selective geometric and electrical considerations. In a preferred embodiment and as discussed with reference to FIG. 7, source elements R (the focusing repeller), E1, E2, and G are positioned 5.6, 4, and 4 mm apart, respectively. In this instance, the majority of R is 4.0 mm away from E1. The concave recess is positioned 1.6 mm deeper than R's E1 facing surface. In the embodiment in which R is an x-y-z sample stage assembly, the entire surface of R is positioned 5.6 mm away from E1.

Element E1 is a concave extractor 4 mm thick at its periphery and 1 mm thick adjacent to its central aperture. The central aperture is 7 mm in diameter and is covered with a 90% T grid on the R side. The angle of the concavity (theta) is 14 degrees with respect to E1's E2 facing surface. The peripheral aspect of E1 contains a laser channel 902 permitting propagation of the laser beam through the body of E1 without introducing electrical field distortion in the R–E1 region.

Element E2 is 1 mm thick and contains a 4.5 mm diameter gridless central aperture. The periphery of E2 contains a laser cut-out which allows propagation of the beam through the body of E2 without introducing electrical field distortion in the E1–E2 region. Element G is 4 mm thick and contains a 4.5 mm-diameter central aperture covered by a 90% T grid on the E2-facing side.

For DC operation, high voltage potential ratios for R: E1: E2 are 1.0: 0.625: 0.25. Consequently, if R is established at 28 KV, E1 is set to 17.5 KV while E2 is set to 7 KV. For the lag phase of TLF operation, the potential ratios for R: E1: E2 are 1.0: 1.0: 0.5. For both modes of operation, plate G is held at ground potential. For positive ion scan mode, all potentials are positive and for negative ion scan mode, all potentials are negative.

FIG. 11 provides further details of the source's electrical system. A single high voltage power supply (HVPS) is used to generate the required potentials for both TLF and DC operation. The previously discussed source element high voltage ratios are achieved by the respective voltage drops across resistors R4, R5, and R6. Ballast resistors R1, R2, and R3 respectively protect R, E1, and E2 from any aberrant AC signals stemming from HVPS ripple or back electromotive force creating during the ion ejection pulse phase of TLF operation.

Capacitors C1 and C2 augment the capacitance in the regions between E1 and E2 and E2 and ground, respectively. This serves to minimize unwanted pulse division from occurring in these regions during TLF operation. Capacitor C3 is a coupling capacitor that functions to link R with the output of a high voltage pulser and ground through R7.

Switch SW1 is a single pole, double throw high voltage relay. SW1 functions to select between DC and TLF operation. During DC operation, SW1 connects R to the input side of R4. For TLF operation, SW1 connects R to the output side of R4, raising it to the same potential as E1. This approach provides the maintenance of a constant equipotential setting of R and E1 regardless of the HVPS output voltage.

As previously noted, capacitor C3 couples R to the output of a high voltage pulser as well as with ground through resistor R7. When R is raised to DC acceleration potentials, C3 is charged and serves as an electron reservoir. During the desorption/ionization phase of MALDI analysis, both positive and negative ions are generated. In positive scan mode operation, positive ions are repelled by R and ejected by the ion optic assembly while negative ions are attracted to R and may ultimately plate out. This plating process creates a charge depletion within R, ultimately reducing and/or collapsing the R–E1 electrical field until depleted charge can be replaced by the HVPS and associated cables. The additional electrons stored within C3 are immediately evoked to stabilize the R–E1 field during this process, resulting in improved resolution and accuracy. The required values for C3 and R7 are such so that the charging duty cycle of C3 is taken to be less than 200 milliseconds.

Figure 12:
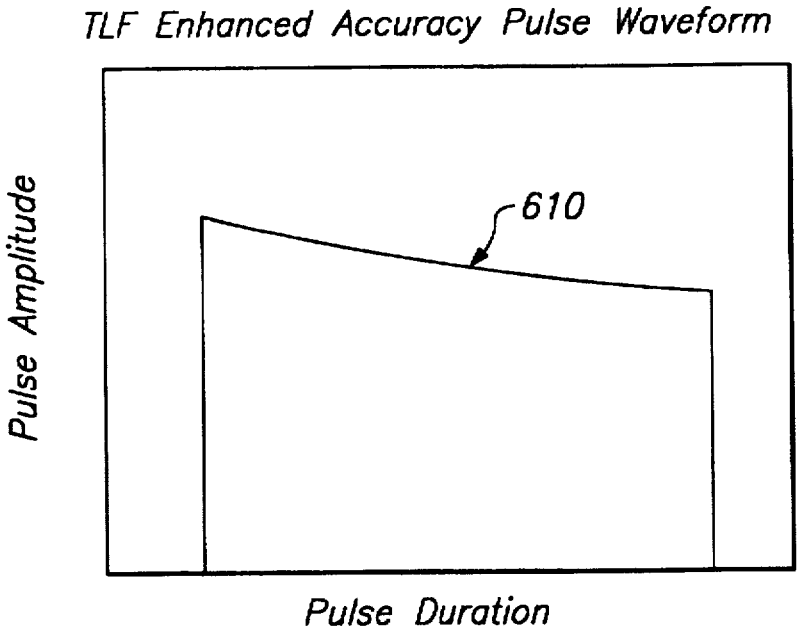
FIG. 12 is a representation of descending wave pulse at R1 according to the present invention.

Because the pulser is capacitively coupled to R via C3, it is electrically isolated with respect to any DC offsets and does not require floating. Resistor R7 is selected to drain off any AC coupled voltage offsets on C3 as well as to modify the output pulse of the pulser so that the pulse waveform is not a constant square wave during TLF operation (see FIG. 12). R7 acts as a current sink which then attenuates the amplitude of the ion ejecting pulse over time dependent upon the values of C3 and the internal capacitance of the HV pulser-C3 conductive pathway.

The waveform 610 (FIG. 12) applied as an ion ejection pulse compensates for the total kinetic energy debt seen between high molecular weight and low molecular weight ions. When the pulse is first applied, all ions see a maximum ejection potential and m/z dependent differential acceleration imparts greater velocities to lighter ions than for heavier ions. Lighter ions will ultimately leave the R–E1 region before heavier ions. Consequently, the time-based integral of ejection pulse amplitude is greater for lighter ions than it is for heavier ions. Accordingly, the imparted kinetic energy to lighter ions is greater than that for heavier ions. R7 (FIG. 11) is selected so that the difference in imparted kinetic energy for lighter and heavier ions compensates for the difference in initial kinetic energy between these ions. Additionally, R7 selection is dependent upon the degree of field penetration seen in the R–E1 region. The net result is a more linear time-of-flight expression, greatly enhancing mw accuracy in external standard calibration modes of operation.

Figure 13:
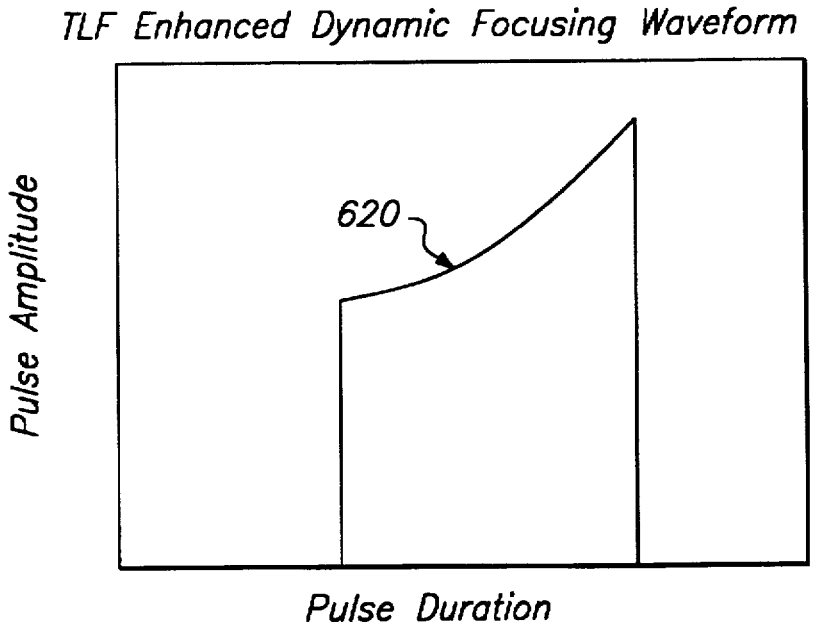
FIG. 13 is a representation of TLF enhanced dynamic focusing waveform according to the present invention.

FIG. 13 depicts an ion ejection pulse waveform 620 which increases in amplitude as a function of time. This ion ejection pulse functions to increase the dynamic focusing range for TLF measurements. As previously noted, the Uo distribution width for large ions is greater than that for small ions. Consequently, no single, constant ion ejection pulse can improve resolution for ions of a diverse molecular weight range.

One approach to correct for this problem is to apply an ion ejection pulse whose amplitude increases with respect to time. In this instance, ion ejection field strength increases as ions are ejected from the R–E1 region. Smaller ions depart before larger ions leave. Consequently, larger ions see a greater total ion ejection acceleration than smaller ions. The slope of the ejection pulse is selected so that differential acceleration is applied to ions of a different m/z allowing for optimal focusing for all ions, thus extending the tlf dynamic focusing range.

While the use of an increasing ion ejection pulse functions to extend the TLF dynamic focusing range, it introduces nonlinearity into the Time-Of-Flight expression. This nonlinearity may be corrected if the following algorithm is used during internal and external standard calibration:

$$m/z=a[(tf-to)(1+b)]^2$$

where solutions for a and b are solved during the calibration process.

Figure 14:
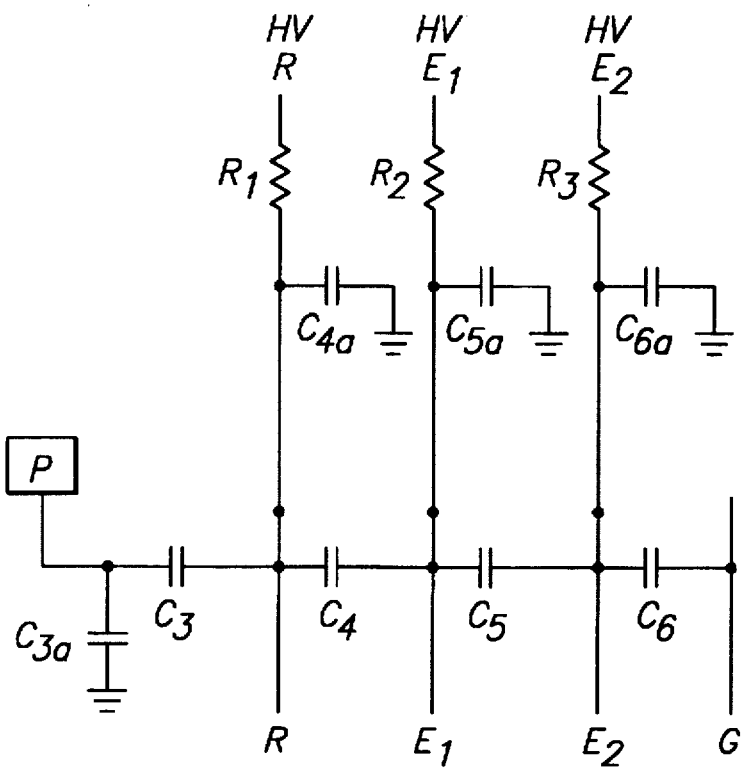
FIG. 14 is a schematic of effective capacitance contribution of source acceleration of high voltage cable.

To further minimize unwanted ion ejection pulse division among ion optic elements, it is necessary to insure the proper lengths for high voltage supply cables to R, E1, and E2. FIG. 14 depicts the capacitive elements within the source cable assembly. C3 is the previously described source coupling capacitor while C3a is the effective capacitance of the HV pulser cable. C4 represents the net capacitance between R and E1 while C4a represents the effective capacitance of the high voltage supply cable to R. C5 is the net capacitance between E1 and E2 while C5a represents the effective capacitance of the high voltage supply cable to E1. C6 is the net capacitance between E2 and G while C6a represents the effective capacitance of the high voltage cable to E2.

In order to prevent unwanted distortion of the ion ejection pulse, C3a must be very, very small. Consequently, the HV pulser cable should be of very short length and very low capacitance. In order to insure that the net capacitance across R–E1 is far, far less than the corresponding values for E1–E2 and E2–G, the length of the R high voltage cable should be as short as possible while the length of the E1 and E2 high voltage cables should be as long as practical.

Further assurance of optimal DC or TLF operation is provided by careful definition of system operation during sample analysis. Pulsed electrical triggers and fields must be applied in the proper order to guard against unnecessary pulse coupling which may deleteriously effect ion optic spatial and temporal focusing. Additionally, time To must be minimized by proper selection of data digitizing trigger events in both DC and TLF operation.

Figure 15:
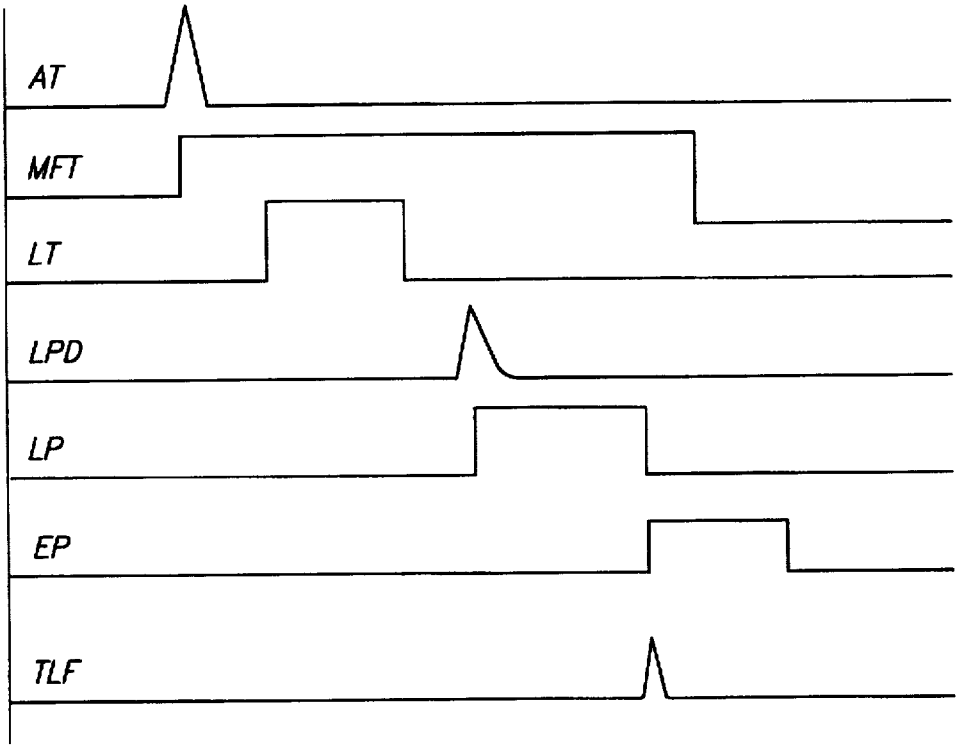
FIG. 15 is a representation of preferred operational cascade for optimized DC/TLF MALDI-TOF system according to the present invention.

FIG. 15 outlines a preferred operational cascade for an optimized DC/TLF MALDI-TOF MS system. Trace AT represents the acquisition trigger, that command which is issued to initiate this cascade. Trace MFT represents the trigger to the pulsed ion gate mass filter (MF). Trace LT represents the trigger sent to fire the system's laser. Trace LPD represents the output pulse of a trigger photodiode which is activated by the laser's lazing event. Trace LPD functions as the trigger pulse for the start of data acquisition during DC operation. Trace LP represents the length of the lag period. Trace EP represents the duration of the ion ejection pulse. Trace TLF represents the trigger pulse for the start of data acquisition during TLF operation. Detailed ramifications of this cascade are discussed below.

After initializing the AT trigger, the system's pulse field MF is applied if it is to function as a high pass filter. Applying the filter prior to firing the laser prevents any unwanted coupling of the MF with acceleration optic elements in the presence of desorbed ions. After about one microsecond, when all MF coupling to acceleration optics has extinguished, the laser trigger is sent to initiate the lazing event. If the filter is to be used as a low pass or notch filter, the MFT pulse is applied after all ions have left the acceleration optics and entered the free flight spool.

The lazing event is detected by a trigger photodiode which then creates output pulse LPD. For TLF operation, pulse LPD functions to activate a timer which establishes the lag period. Upon completion of the lag period, the lag period timer circuitry creates pulse EP, triggering the high voltage pulsing system to create the ion ejection pulse. Pulse TLF is created by inductively coupling with the HV pulser output line. Pulse TLF functions to established time To for the digital acquisition system as well as functioning to trigger a timer which controls the effective MF period for high pass operation.

During DC operation, pulse LPD functions to supply time To for the digital acquisition system as well as triggering a timer which controls the effective MF period for high pass operation. The use of discretely different To trigger cascades for TLF and DC operation insures that the duration of To is as short as possible. The latter results in improved molecular weight determination accuracy for low mass ions where the Tf approaches To.

Figure 16:
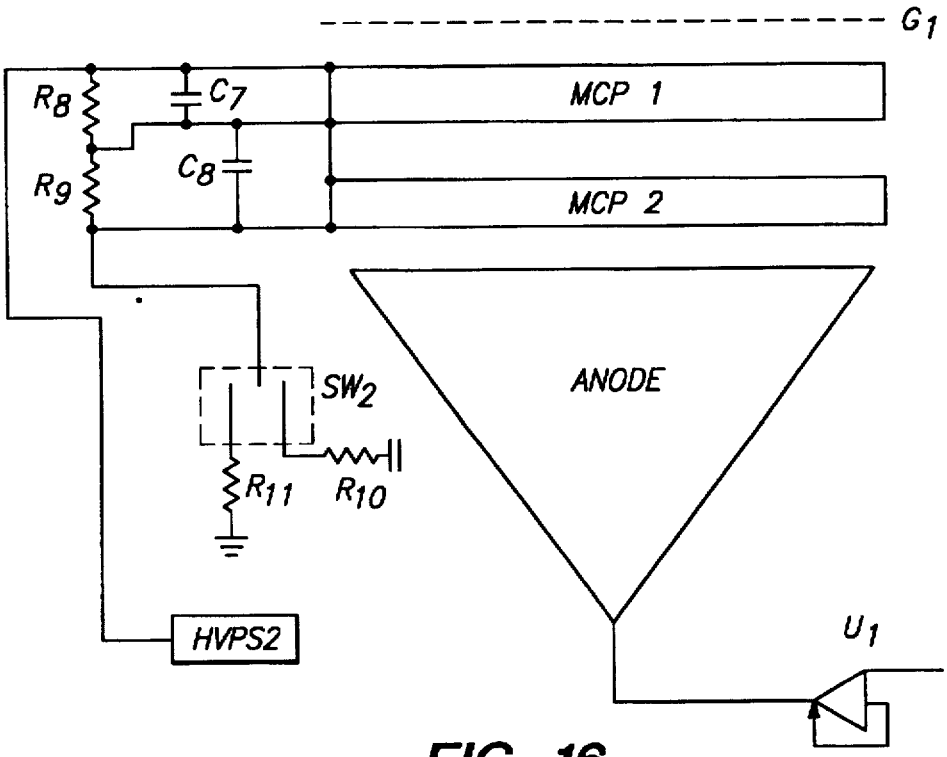
FIG. 16 is a representation of the detector means as taught in the present invention.

FIG. 16 depicts a preferred high resolution/high molecular weight ion sensitive detector for DC or TLF MALDI-TOFMS. The detector is a dual microchannel plate array design which utilizes an elegant secondary ion generator which is an integral component of the first microchannel plate conversion surface.

G1 is a high transmission, field retaining grid. It is composed of but not limited to stainless steel, or other hard, sputter-resistant conductive elements. G1 grid density is between 20 and 100 lines per inch. The first ion conversion surface (microchannel plate one: MCP1) is located 0.1 to 4.0 mm below and parallel to G1.

MCP 1 can be a standard N-type or high output type (HOT) microchannel plate. The structural portion of MCP 1's conversion surface is coated with a metal such as but not limited to copper; nickel; platinum; chromium; zinc; silver; gold; cadmium; and paladium, which have high sputtering potential to easily create secondary ions from the direct impact of high energy primary ions. Approximately 40–70 percent of MCP1's conversion surface is structural while the remaining surface contains active micro channels.

Micro channel plate two (MCP2) is located immediately below and parallel to MCP1. MCP2 is a HOT microchannel plate. The detector anode is located 1 to 10 mm below and parallel to the lower surface of MCP2.

G1 is constantly held at ground potential. The potential difference between the conversion surface of MCP1 and G1 is controlled by the detector high voltage power supply (HVPS2). Regardless of the potential difference between MCP1 and G1, the applied potential difference across MCP1 and MCP2 are limited not to exceed 1000 volts by dividing resistors R8 and R9 when used in series with resistors R10 or R11. Selection between resistors R10 and R11 is achieved via switch 2 (SW2), a single throw, double pole high voltage relay.

For high resolution operation, HVPS2 is set to −2000 volts and SW2 connects R9 to R10. The values of R8, R9, and R10 are selected so that the approximately −1 KV is dropped across MCP's 1 and 2. For high molecular weight ion sensitivity mode, HVPS2 is set to −5000 volts and SW2 connects R9 to R11. The resistive network of R8, R9, and R10 is such so that approximately −1 KV is dropped across MCP's 1 and 2.

During MALDI-TOF MS analysis, high energy parent molecular ions are accelerated towards the detection conversion surface at energies approaching 30–40 KeV. It has been shown that such energies are sufficient to cause the sputter of secondary metal ions from grid or metal coating surfaces. Our laboratory has shown the energy profiles of these sputtered ions from metal coated surfaces to range from 0 to greater than 5 KeV. Such sputtering is also seen when high energy parent molecular ions strike the surface of a metal coated MCP plate.

Selective recovery and conversion of these sputtered ions is achieved by varying acceleration potentials above the microchannel plate surface. If relatively low energy fields exist (i.e. less than 1.3 KV/mm) between G1 and MCP1, very few sputtered product ions are reaccelerated towards MCP1's surface resulting in poor ion conversion efficiency. If high energy fields (i.e. greater than 3.5 KV/mm) exist between G1 and MCP1, a large number of sputtered product ions are turned around to collide with the surface of MCP1. The net result is an increase in sputtered ion conversion efficiency.

Because some parent molecular ions undergo free flight metastable decay to yield smaller neutral and product ions, a finite degree of time spread is created as parent and product ions of a particular species are accelerated across G1 to MCP1. This creates an array of sputtering activity in which, for positive ion mode, smaller product ions impact first, followed by intact parent ions, which are then followed by neutral ions. Each of these populations can create secondary sputtered ions across a broad time frame. Additionally, because sputtered ions are released in various directions with various initial energies, an additional degree of temporal spread is created.

For high resolution measurements, the aforementioned contributions to time spread which occur during secondary ion sputtering can seriously limit achievable resolution. Consequently, conversion of these sputtered ions is not desired. In this embodiment, conversion of sputtered ions can be minimized by setting HVPS2 to −2000 volts and SW2 to connect R9 with R10. A weak electric field will be established between G1 and MCP1, allowing most of the sputtered products to be released through G1 and into the analyzer region. Only those sputtered products with energies of less than 2 KeV will be reaccelerated towards the conversion surface of MCP1. Additionally, upon impact with MCP1, these ions will possess less than 2 KeV of energy, making their conversion efficiency low when compared to that of their parent molecular ions. Consequently, a very low sputtered ion signal will be detected in comparison to the signal generated during the detection of parent molecular ions.

Because the energy spread among a given population of very large ions (m/z>50,000 Da) is too large to time lag focus using practical pulse voltages or lag times, any time spread created at the detector is insignificant compared to that time spread contributed by the initial ion kinetic energy distribution. Consequently, it is not necessary to minimize time spread at the detector while detecting ions of very large m/z. Under these conditions, HVPS2 is set for −5 KV and SW2 connects R9 to R11. A strong field is applied between G1 and MCP1 and all sputtered products with kinetic energies <5 KeV are accelerated back to MCP1's conversion surface. In this case, the conversion efficiency of these sputtered products at −5 KeV of energy is greater than that for the very large parent molecular ions at 35 KeV.

The result is a detected ion signal for the sputtered products at much greater intensity than that of the parent molecular ions. Because the difference in Tf between parent signals and their corresponding sputtered signals is extremely small when compared to the to Tf of parent molecular ions, the overall contribution to molecular determination error in referring to the sputtered ion signal as the parent molecular ion signal is taken to be less than 200 ppm for a parent ion of 50,000 m/z.

The foregoing descriptions of specific embodiments of the invention taught herein have been presented for the purpose of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. An apparatus for measuring the mass of molecules desorbed and ionized by laser irradiation of a sample, the apparatus comprising:

a) detector means for detecting said desorbed and ionized molecules and generating an electrical signal therefrom;

b) ion gate means including a pulsed ion gate assembly for gating preselected ion populations to said detector, and c) ion optic assembly including an ion optics acceleration means for directing desorbed and ionized molecules to said detector means, said acceleration means switchable between continuous DC and time lag focusing mode, wherein said ion optic assembly receives samples introduced in a plurality of predetermined positions on a cylindrical sample probe, and said probe is closely associated with said ion optic assembly during operation.

2. The apparatus of claim 1 wherein the ion optic assembly further comprises a sample receiving means having a three dimensional moveable x-y-z stage receptive to a sample-containing layer of gel or membrane on a sample receiving surface of said stage, said layer being of substantially uniform thickness; said sample receiving means further comprising a retaining grid for physically and electrically clamping said layer to said stage receiving surface.

3. The apparatus of claim 2 comprising means for raising the potential of the ion optic assembly x-y-z stage by application of an alternating current until attaining target voltage levels and then switching to static direct current sufficient to maintain target voltage, whereby a homogeneous electrical clamping is created among sample presenting surfaces of varying conductivity or dielectric properties.

4. The apparatus of claim 1 wherein, the ion optic assembly is pumped by a first turbomolecular ultrahigh vacuum pump and an analyzer region is pumped by a second turbomolecular ultrahigh vacuum pump.

5. The apparatus of claim 1 further comprising means for selectively applying preselected high voltage potentials to elements of said ion optic assembly, wherein said means comprise high voltage relays and voltage dividing networks.

6. The apparatus of claim 5 wherein said high voltage relays and voltage dividing networks operate and toggle said detector between a high resolution mode and a high molecular weight sensitivity mode.

7. The apparatus of claim 1 further comprising means for delivering predetermined ion ejection pulses to said ion optic assembly, wherein said means comprise capacitive coupling means electrically associated with an ion optic repeller element of said ion optic assembly.

8. The apparatus of claim 1 further comprising an analyzer means, wherein said analyzer means comprises a pulse field ion gate for preselecting ion populations gated toward the detector.

9. The apparatus of claim 1 wherein the desorptive/ionizing laser energy is delivered through laser optics which direct laser pulse into said ion optic assembly and provide a means for detecting the lazing event.

10. The apparatus of claim 1 wherein said ion optic assembly and said ion gate assembly are physically and electrically partitioned by an insulative partition in an instrument chamber, said partition located so as to create a source region and an analyzer region within the apparatus during TOF operation, thereby minimizing unwanted coupling of pulsed signals between the two assemblies.

11. The apparatus of claim 1 further comprising a voltage dividing network for toggling between DC and TLF optic potentials and focusing modes.

12. The apparatus of claim 1 further comprising ballast resistors to minimize source ripple and to back electromotive force during static or pulsed source operation.

13. The apparatus of claim 1 further comprising capacitors to augment capacitance in non-TLF focusing source regions to minimize unwanted pulse division to such regions during the application of an ion ejecting pulse.

14. The apparatus of claim 1 further comprising a coupling capacitor positioned so as to combine a TLF pulser with a source repeller which is established at a significant DC offset voltage.

15. The apparatus of claim 1 further comprising means for providing a time-dependent-decreasing ion ejection pulse amplitude.

16. The apparatus of claim 15, wherein a time-dependent-decreasing ion ejection pulse amplitude compensates for the initial kinetic energy debt between low and high molecular weight ions, thereby improving the accuracy of molecular weight determination by correcting for non-linearity in TOF expression.

17. The apparatus of claim 1 wherein a preferred operational cascade comprises:

(a) an acquisition trigger command to initiate said operational cascade;

(b) a trigger to pulse the ion gate mass filter;

(c) a trigger to fire the laser;

(d) a photodiode trigger activated by laser firing;

(e) a trigger pulse for initiating data acquisition during DC operation; and (f) a trigger pulse for initiating data collection during TLF operation.

18. The apparatus of claim 1 further including a high molecular weight ion-sensitive detector having a second ion generator as an integral component of an ion-to-electron conversion surface.

19. The apparatus of claim 1 further comprising a detector means for varying post acceleration field strength to convert or release sputtered secondary ions from a secondary ion generator, wherein said variance in the field strength enables toggling between high resolution and high mass sensitivity operational modes.

20. The apparatus of claim 1, wherein said detector includes an ion converting means comprised of nonactive structural components, said components comprised generally of metal of high sputter potential.

21. A DC/TLF Ion Optic assembly comprising a plurality of plates including an R, E1, E2, and G disk, wherein:

(a) the R disk is a concave spherical disk operable as an ion focusing repeller;

(b) the E1 disk is a concave spherical disk thicker at the periphery than at the center and operable as an ion focusing extractor;

(c) the E2 disk is a substantially spherical disk of uniform thickness operable as an ion focusing extractor; and (d) the G disk is a substantially spherical disk of uniform thickness electrically connected directly to an operable ground plane, wherein the R, E1, E2, and G disks are arranged in parallel along a common centerline in the order R, E1, E2 and G and have predetermined spaces therebetween respectively forming inter-disk regions R–E1, E1–E2, and E2–G, the R, E1, E2, and G disks are selected to have diameters which augment capacitance in the E1–E2 and E2–G regions relative to the R–E1, region, and dielectric insulators are inserted between said R, E1, E2 and G disks so as to physically separate and support said disks, wherein said insulators are selected to have diameters and surface areas which augment capacitance in the E1–E2 and E2–G regions relative to the R–E1 region.

22. The assembly of claim 21, wherein said R disk comprises an x-y-z platform with a sample presenting surface.

23. The assembly of claim 22 further comprising a sample layer retaining grid for physically and electrically clamping a sample layer to the sample presenting surface.

24. The assembly of claim 22, wherein the x-y-z platform further comprises raised peripheral regions relative to the center of the sample presenting surface such that electrical fields which are focused or parallel are created at said raised regions.

25. The assembly of claim 21, wherein the E1 disk comprises a central concavity containing a centrally located aperture and a grid covering said aperture, and said E1 disk is configured to have a diameter and thickness sufficient to attain a predetermined degree of field penetration within the isopotential lag region of a TLF source defined by said R–E1 and E1–E2 regions as a means of compensating for the initial kinetic energy debt between small and large ions, thereby improving accuracy in molecular weight determination by correcting for non-linearity in time-of-flight expression.

26. The apparatus of claim 21 further comprising a voltage dividing network to create optimal isopotential conditions between said R and E1 disks during the lag period of a TLF duty cycle.

27. The assembly of claim 21 further comprising a resistor simultaneously coupling an output of said coupling capacitor to ground as well as to said R disk during TLF and DC operational modes, respectively.

28. The assembly of claim 27 further comprising a coupling capacitor connected through a resistor to a ground plane with a source's repeller for the storage for additional charge which is readily transferred to the source repeller to minimize field collapse during desorption and ionization, thereby providing improved resolution and accuracy in DC TOF measurements.

29. The assembly of claim 28 further comprising a switching high voltage relay to switch a repeller connection to different points of a voltage dividing chain, so as to toggle between DC and TLF source operations.

30. The assembly of claim 27 further comprising a high voltage pulser (HVP) capacitively coupled to a repeller whereby the capacitor operates so as to apply ion ejection pulses to said repeller during TLF operation.

31. A method of automated molecular weight sample analysis comprising:

(a) providing an DC/TLF apparatus which includes the DC/TLF ion optic assembly of claim 21;

(b) introducing a sample for molecular weight analysis into said DC/TLF apparatus; and (c) combining the steps of DC operation and TLF operation to determine the molecular weight of a component in said sample.

32. The method of claim 31 further comprising the step of creating a composite mass spectrogram through constructing a series of TLF analyses performed so as to optimize the resultant resolution of each component in a multicomponent sample mixture.

33. The assembly of claim 21 further comprising a time-dependent increasing ion ejection pulse amplitude.

34. The assembly of claim 33, wherein said-time-dependent increasing ion ejection pulse amplitude is operated to extend the dynamic focusing range of the apparatus.

* * * * *

UNITED STATES PATENT AND TRADEMARK OFFICE

CERTIFICATE OF CORRECTION

PATENT NO : 5,777,325

DATED : Jul. 7, 1998

INVENTOR(S) : Weinberger et al.

It is certified that error appears in the above-identified patent and that said Letters Patent are hereby corrected as shown below:

At (73) Assignee: Hewlett-Packard Company, Palo Alto, Calif.

insert: --and The Governors of the University of Alberta, Edmonton, Canada--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*